US009660377B2

(12) United States Patent
Greig et al.

(10) Patent No.: US 9,660,377 B2
(45) Date of Patent: May 23, 2017

(54) CONNECTOR APPARATUS

(71) Applicant: PHITEK SYSTEMS LIMITED, Auckland (NZ)

(72) Inventors: Nigel Greig, Auckland (NZ); William James Sim, Auckland (NZ); Edward Scholten, Auckland (NZ); Brendon David Midgley, Auckland (NZ); Hamish Dublon, Auckland (NZ); Roy Moody, Auckland (NZ)

( * ) Notice: Subject to any disclaimer, the term of this patent is extended or adjusted under 35 U.S.C. 154(b) by 0 days.

(21) Appl. No.: 14/945,591

(22) Filed: Nov. 19, 2015

(65) Prior Publication Data

US 2016/0240965 A1 Aug. 18, 2016

Related U.S. Application Data

(63) Continuation of application No. 13/847,268, filed on Mar. 19, 2013, now Pat. No. 9,209,558.

(60) Provisional application No. 61/612,970, filed on Mar. 19, 2012.

(51) Int. Cl.

| | |
|---|---|
| ***H01R 27/00*** | (2006.01) |
| ***H01R 13/62*** | (2006.01) |
| ***H01R 13/652*** | (2006.01) |
| ***H01R 13/66*** | (2006.01) |
| *H01R 13/24* | (2006.01) |

(52) U.S. Cl.

CPC ..... *H01R 13/6205* (2013.01); *H01R 13/652* (2013.01); *H01R 13/6683* (2013.01); *H01R 13/24* (2013.01); *H01R 27/00* (2013.01); *H01R 2201/26* (2013.01)

(58) Field of Classification Search

CPC H01R 27/00; H01R 13/6205; H01R 13/7031; H01R 31/06; H01R 2103/00; H01R 13/703; H01R 13/7032; H01R 11/30

USPC ..... 439/218, 188, 39; 200/51.09, 51.1, 51 R

See application file for complete search history.

(56) References Cited

U.S. PATENT DOCUMENTS

| | | | | |
|---|---|---|---|---|
| 3,868,160 | A * | 2/1975 | Kersman | H01R 13/7037 200/51 R |
| 5,413,493 | A * | 5/1995 | Hoffman | B60L 11/1818 200/51.09 |
| 6,528,746 | B2 * | 3/2003 | DeWitt | H01R 13/7037 200/51.09 |
| 6,561,827 | B2 * | 5/2003 | Frostrom | H04Q 1/13 439/188 |
| 7,021,951 | B2 * | 4/2006 | Tronolone | H01R 13/7038 200/51.1 |
| 7,311,526 | B2 * | 12/2007 | Rohrbach | H01R 13/6205 439/218 |
| 7,874,844 | B1 * | 1/2011 | Fitts, Jr. | H01R 13/6205 439/218 |
| 8,251,723 | B2 * | 8/2012 | Tsai | H01R 24/38 439/108 |
| 8,894,419 | B1 * | 11/2014 | Buelow | H01R 13/6205 439/218 |

(Continued)

*Primary Examiner* — Gary Paumen

(74) *Attorney, Agent, or Firm* — Jackson Walker LLP

(57) ABSTRACT

A magnetic electrical connector is provided which has particular application to use in vehicles or aircraft to prevent damage due to passenger movement. The connector includes a socket having a housing with a front face, a plurality of conductor contact regions provided on the front face, and a magnet provided in the housing to physically retain a plug in connection with the socket in use.

19 Claims, 42 Drawing Sheets

(56) References Cited

U.S. PATENT DOCUMENTS

Figure 1:
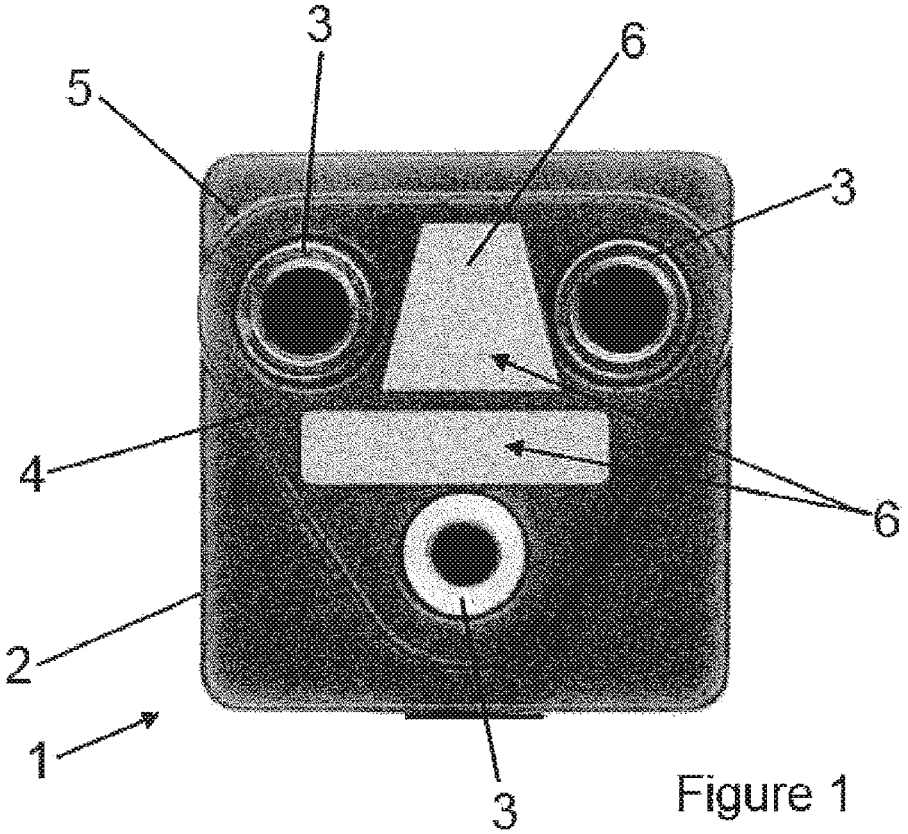

| | | | | |
|---|---|---|---|---|
| 9,004,924 | B2 * | 4/2015 | Kuo | H01R 13/6205 439/188 |
| 9,209,558 | B2 * | 12/2015 | Greig | H01R 13/6205 |
| 9,413,113 | B2 * | 8/2016 | Lin | H01R 13/52 |
| 2007/0254510 | A1 * | 11/2007 | DeBey | H01R 13/6205 439/188 |
| 2009/0192927 | A1 * | 7/2009 | Berg | G06Q 30/04 705/34 |
| 2010/0029110 | A1 * | 2/2010 | Kiryu | H01R 13/7038 439/188 |
| 2010/0279532 | A1 * | 11/2010 | Inage | H01R 13/641 439/188 |
| 2012/0264316 | A1 * | 10/2012 | Cameron | H01R 29/00 439/188 |
| 2013/0337673 | A1 * | 12/2013 | King | H01R 13/713 439/188 |
| 2014/0259651 | A1 * | 9/2014 | Fletcher | H01R 13/71 29/825 |
| 2015/0236455 | A1 * | 8/2015 | Lin | H01R 13/7036 439/188 |

* cited by examiner

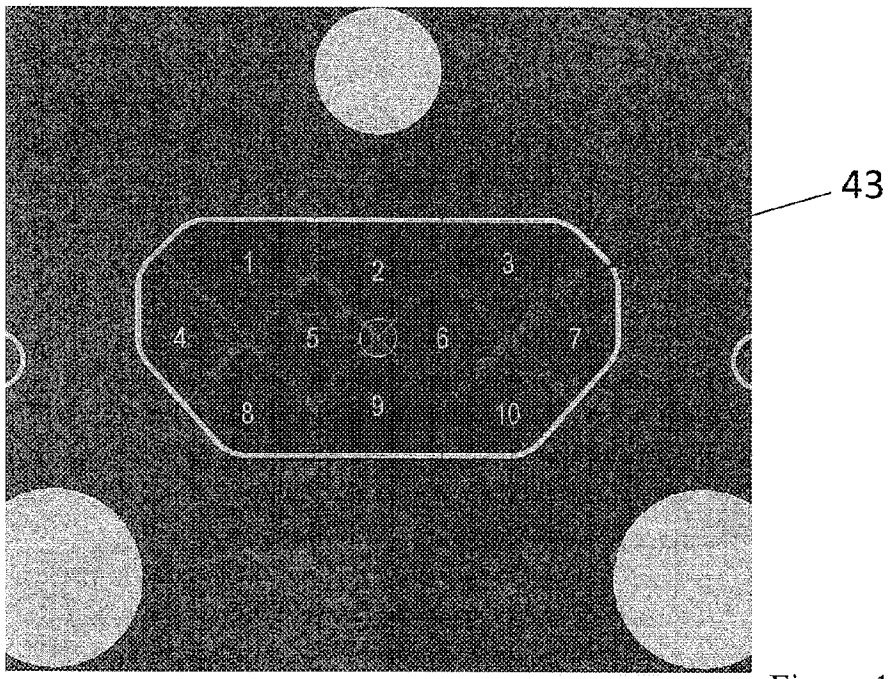
Figure 11 Part 1
| | |
|---|---|
| 1 | DRIVER_LEFT |
| 3 | DRIVER_RIGHT |
| 2 | DRIVER_GND |
| 6 | ID |
| 8 | MIC_LEFT |
| 10 | MIC_RIGHT |
| 9 | MIC_GND |
| 4 | V+ |
| 5 | NC |
| 7 | PGND |
Figure 11 Part 2

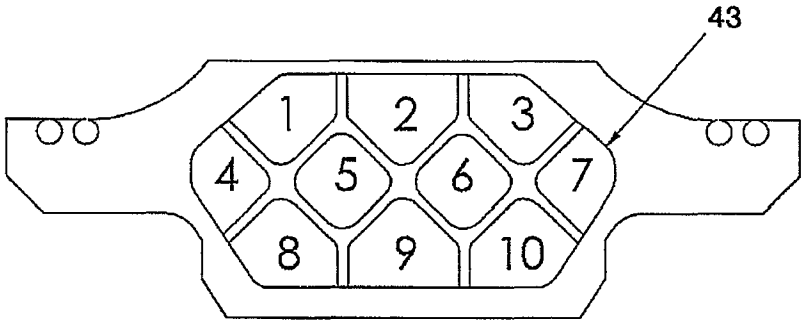
Figure 11a Part 1

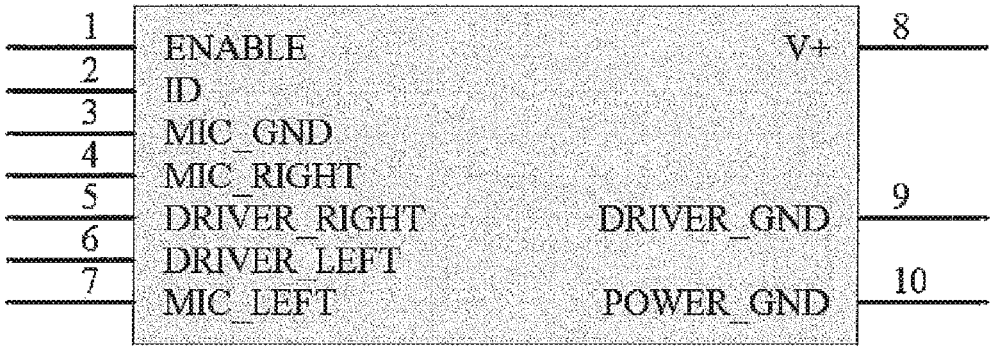
FIG 11a Part 2

43

CONNECTOR APPARATUS

RELATED APPLICATIONS

This application is a continuation of U.S. patent application Ser. No. 13/847,268, entitled "Connector Apparatus" and filed on Mar. 19, 2013, which claims priority to U.S. Patent Application No. 61/612,970, entitled "Connector Apparatus" and filed on Mar. 19, 2012. These prior applications are herein incorporated by reference.

Field of the Invention

This invention relates to connector apparatus. The invention is directed particularly, but not solely, to connector apparatus for making electrical connection between a media source and media delivery equipment, for example, an audio signal connection between apparatus such as a headset and an audio signal source such as that provided by an in-flight entertainment system.

BACKGROUND

Conventional connectors typically comprise a socket, and a plug which is received in the socket. For example, in an airline cabin, an in-flight entertainment system may provide media such as audio and video information to passenger seat locations, so that it is available to passengers. The video information is typically made available via a visual display unit located on the rear of a seat immediately in front of the passenger. Audio information is typically provided via a connector socket (sometimes referred to as a jack) which is provided adjacent to the seat, for example, in the arm rest. The user is typically provided with a headset which has a plug which is received in the socket, so that the audio information is delivered to the headset.

A problem can occur when tension is applied the headset plug. If the tension is applied in a direction so as to pull the plug axially from the socket, then no damage will usually occur. However, if tension is supplied in a direction other than the axial direction, such as a perpendicular direction, then breakage may occur. This is because the plug typically includes one or more elongate pins which are received in the socket. Unless the plug pins are removed in an axial direction, there is a risk that the plug pins can break. This is often a problem within aircraft cabins, since a headset, or headset cable, can frequently be moved unintentionally. One example is a situation in which a passenger forgets that the headset is still being worn and rises from his or her seat, causing the headset cable to violently pull the plug from the socket. Another example is when an object is being moved in the vicinity of the seat, for example, a pillow or food tray which may catch on the headset cable, causing the plug to be torn from the socket.

A connector apparatus which goes at least some way to addressing the above problems is described in U.S. Ser. No. 13/337,117, the entire contents of which are incorporated herein by reference. According to particular arrangements described therein, electrical connection may be effected by means of conductors (preferably contact pins) which engage with conductor contact regions (preferably formed by a conductive layer on a housing of a socket). Magnets may be used to releasably secure a plug in a socket so as to maintain the connection during normal use but allow for disconnection, including in the abovementioned circumstances.

While the arrangements described in U.S. Ser. No. 13/337,117 provide significant advantages over prior arrangements, there is a continued need for further improvements in the integrity of the connection as well as in avoiding possible failures or improving safety.

OBJECT OF THE INVENTION

It is an object of the present invention to provide an improved connector apparatus, or to at least provide connector apparatus which provides a useful alternative to known connector apparatus or systems.

SUMMARY

In one aspect the invention provides an electrical connector socket comprising:

a housing having a front face, a plurality of conductor contact regions provided on the front face, and a magnet provided in the housing to physically retain a plug in connection with the socket in use.

Preferably the conductor contact regions are substantially flush with the front face.

Preferably the conductor contact regions are formed from a layer of conductive material.

Preferably the conductor contact regions are adjacent to each other and in the same plane.

Preferably the socket includes a plug pin receiver.

Preferably the socket may be electrically connected to a plug via the conductor contact regions or via the plug pin receiver.

Preferably one or more of the conductor contact regions is a power contact region operable to make a power supply available to a plug.

Preferably the power contact region is operated to make power available to the plug once the plug has been connected to the socket.

Preferably the housing comprises an alignment contour to co-act with a contour of a plug to facilitate correct alignment of the plug with the socket.

Preferably the alignment contour comprises a plug pin receiver.

Preferably the conductor contact regions are provided in three rows.

Preferably the rows are parallel with each other, the contact regions in the first and third rows are substantially aligned and the contact regions of the second row are offset with respect to those of the first and third rows.

In another aspect, the invention provides connector apparatus comprising:

a plug having a plurality of conductor contact regions for contacting conductors provided on a socket or receiver; and a magnetic means provided rearwardly of one or more of the contact regions to co-act with a magnetic means associated with the socket or receiver.

Preferably the magnetic means is provided such that in use at least one of the conductor regions is disposed between the magnetic means and the plug.

Preferably the contact regions are provided in a layer.

Preferably the contact regions are defined by one or more insulating layers.

Preferably the apparatus includes an alignment contour to facilitate correct alignment of the plug with a socket.

Preferably the alignment contour comprises a projection or recess for alignment with a corresponding projection or recess on the socket.

Preferably the projection or recess corresponds with a projection or recess on an existing audio jack.

In another aspect the invention provides connector apparatus comprising:

a socket or receiver having plurality of conductor contact regions for contacting conductors provided on a plug; and magnetic means provided rearwardly of one or more of the contact regions to co-act with a magnetic means associated with a plug.

Preferably the magnetic means is provided as such that in use at least one of the conductor regions is disposed between the magnetic means and the socket.

Preferably the contact regions are provided in a layer.

Preferably the contact regions are defined by one or more insulating layers.

Alternatively one or more of the contact regions comprises a spring contact.

Preferably the apparatus includes an alignment contour to facilitate correct alignment of the socket with the plug.

Preferably the alignment contour comprises a projection or recess aligned with the corresponding projection or recess on the plug.

In a further aspect the invention provides connector apparatus comprising:

a plug and/or a socket having a plurality of conductor contact regions, the contact regions being formed from a conductive layer provided on the housing of the plug or socket.

Preferably a physical dimension of the contact regions is defined using one ore more insulating layers.

In a further aspect the invention provides connector apparatus comprising a socket including at least one electrode for providing a power supply to conductors or electrodes of a plug to be adapted for use with the socket, wherein the power supply is only made available to the electrodes once the plug is connected to the socket.

In yet a further aspect the invention provides connector apparatus comprising:

a socket for receiving one or more pins of a plug adapted for connection with the socket, the socket also including a plurality of conductor contact regions for contacting conductors provided on the plug; and a magnetic means for co-acting with a magnetic means provided on a plug.

Preferably the conductor regions are electrically connected to appropriate pin receiving sockets on the socket assembly such that the socket may be operatively connected to equipment having either a plug with one or more pins, or a plug having a plurality of contact regions.

In a further aspect the invention broadly provides connector apparatus comprising a plug having a magnet means and a plurality of contact regions, at least one of the contact regions comprising a spring contact.

Preferably the magnet means is provided rearwardly of the contact regions.

In another aspect the invention broadly provides a pin arrangement for a magnetic connector having three rows of electrical contact pins.

Preferably the rows are provided one above another.

Preferably the pins in the first and third rows are aligned, and the pins of the second row are offset with respect to those of the first and third rows.

In another aspect the invention broadly provides an electrical contact arrangement for a magnetic connector having three rows of electrical contact regions.

Preferably the rows are provided one above another.

Preferably the contact regions in the first and third rows are aligned, and the contact regions of the second row are offset with respect to those of the first and third rows.

In one embodiment the conductor contact regions are form on a printed circuit board. Preferably the printed circuit board is formed such that the contact regions protrude therefrom. Preferably the contact regions are flush with the housing face surrounding them.

In a further aspect the invention provides magnetic connector apparatus comprising a plug and a receiver to which the plugs may be connected, the plug and receiver being capable of alignment in only one orientation.

In a further aspect the invention provides connector apparatus comprising a socket, receiver or plug having an arrangement of contacts or contact regions substantially as shown in any one of FIGS. 2, 5, 6, 8, 11, 12, 20-29 of the accompanying drawings.

In one embodiment the invention provides an electrical connector socket comprising a housing having a front face, a group of substantially planar conductor regions provided on the front face, to contact corresponding pins of one of a plurality of plugs having different pin arrangements and a magnetic material provided in the housing to enable the plugs to be physically retained in connection with the socket in use. Wherein, the conductor regions which provide core functionality are arranged so that pressure from plug pins on the face of a group of conductor regions is substantially balanced for each of the different pin arrangements.

Preferably the pressure on the face of the group of conductor regions is caused by spring pressure from the pins of the connecting plug.

Preferably the pressure is substantially balanced by ensuring that there is a difference in the number of connections either side of a centre line in the middle of the conductor regions of one connection or less for each of the different pin arrangements.

In one embodiment the invention provides an electrical conductor socket comprising a housing having a front face, a group of substantially planar conductor regions provided on the front face, to contact corresponding pins of one of a plurality of plugs, each plug having one of a plurality of predefined electronic pin-outs for contacting selected conductor regions and a magnetic material provided in the housing to enable the plugs to be physically retained in connection with the socket in use. Wherein, the group of conductor regions are arranged so that pressure on a face of the group of conductor regions is substantially balanced for each of the plurality of pin-outs when the plug and socket are in contact.

Preferably the pressure on the face of the group of conductor regions is caused by spring pressure from the pins of the connecting plug.

Preferably the pressure is substantially balanced by ensuring that there is a difference in the number of connections either side of a centre line in the middle of the conductor regions of one connection or less for each of the plurality of predefined electronic pin-outs.

Preferably the group of planar conductor regions comprises a first subgroup consisting of a half of the plurality of conductor regions and a second subgroup of conductor pins consisting of the conductor regions not in the first subgroup. Wherein, pressure on the face of the plurality of conductor regions is substantially balanced for each of the plurality of electronic pin-outs. This is preferably accomplished by there being no more than one conductor region difference between that used in the first and second subgroups when the plug and socket are connected.

Preferably the centre line is a line of symmetry.

Preferably the centre line is vertical.

Preferably the moment around the centre line is substantially balanced by considering the number of connections and the distance of each connection from the centre line.

Preferably the plurality of pins is laid out so as to prevent localised forces at the circumference of the group of conductor regions.

Preferably the conductor regions are provided in a two-dimensional array.

Preferably the most commonly used functionalities are provided by core contact regions, the core contact regions being selected to provide a substantially balanced pressure across the group of conductor regions.

Preferably additional features are available when pins from one of the plurality of plugs with predefined electronic pin-outs are connected to conductor regions not in the core contact regions.

Preferably the magnetic force used is substantially the minimum to hold the plug and socket in connection.

Preferably the most commonly used functionalities are located at positions where the resultant magnetic pulling force is strongest.

Preferably the plurality of predefined electronic pin-outs comprises pin-outs for conventional stereo headsets, active noise reduction functionality and powered active noise reduction.

In one embodiment the invention provides an electrical connector plug comprising, a housing having a front face, a plurality of pins provided on the front face, said pins may be biased out of the front face, and having one of a plurality of predefined electronic pin-outs, and a magnetic material provided in the housing to enable the plug to be physically retained in connection with a socket in use. Wherein, the plurality of pins are arranged so that pressure on a group of conductor regions is substantially balanced for each of the plurality of predefined pin-outs when the plug is in contact with a group of conductor regions.

Preferably pressure is substantially balanced by ensuring that there is a difference in the number of connections either side of a centre line in the middle of the conductor regions of one connection or less for each of the plurality of predefined electronic pin-outs.

Further aspects of the invention will become apparent from the following description.

DRAWING DESCRIPTION

One or more embodiments of the invention will be described below, by way of example only, with reference to the accompanying drawings, in which:

FIG. 1: is a front elevation of a jack or a socket in accordance with one embodiment of the invention.

Figure 2:
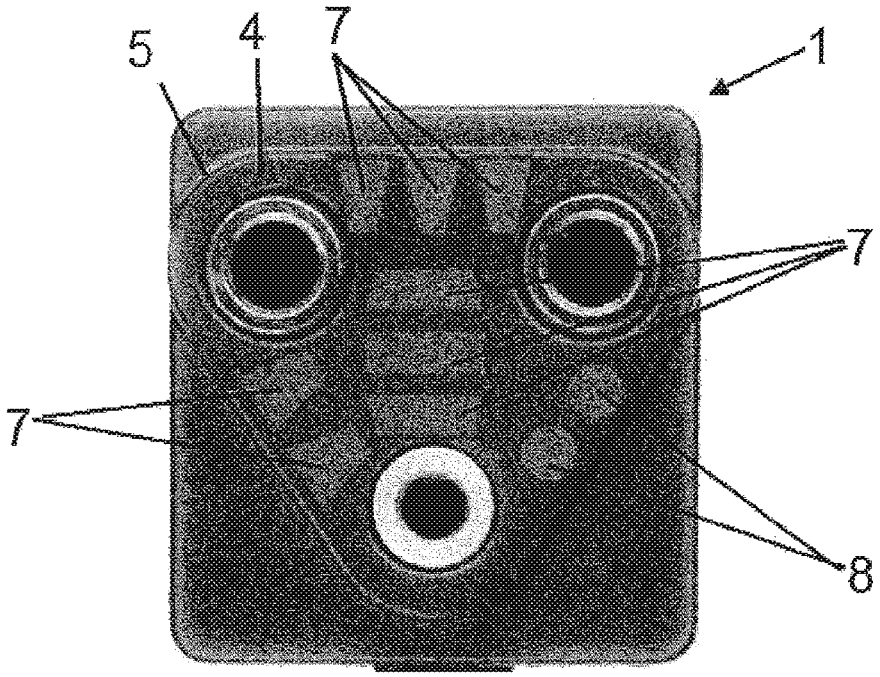

FIG. 2: is a further front elevation of the jack of FIG. 1.

Figure 3:
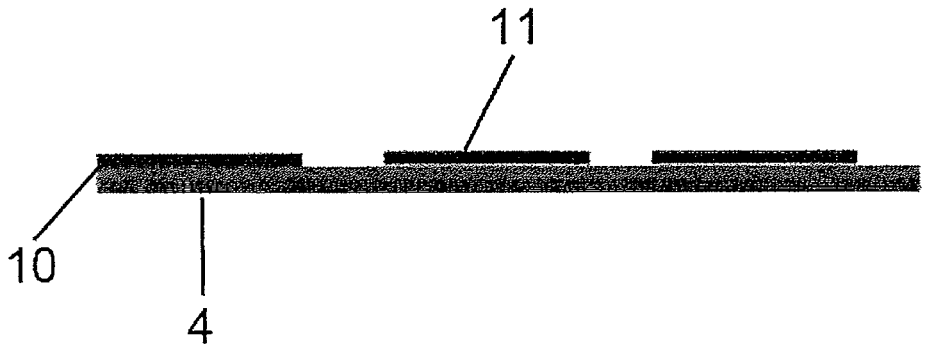
Figure 4:
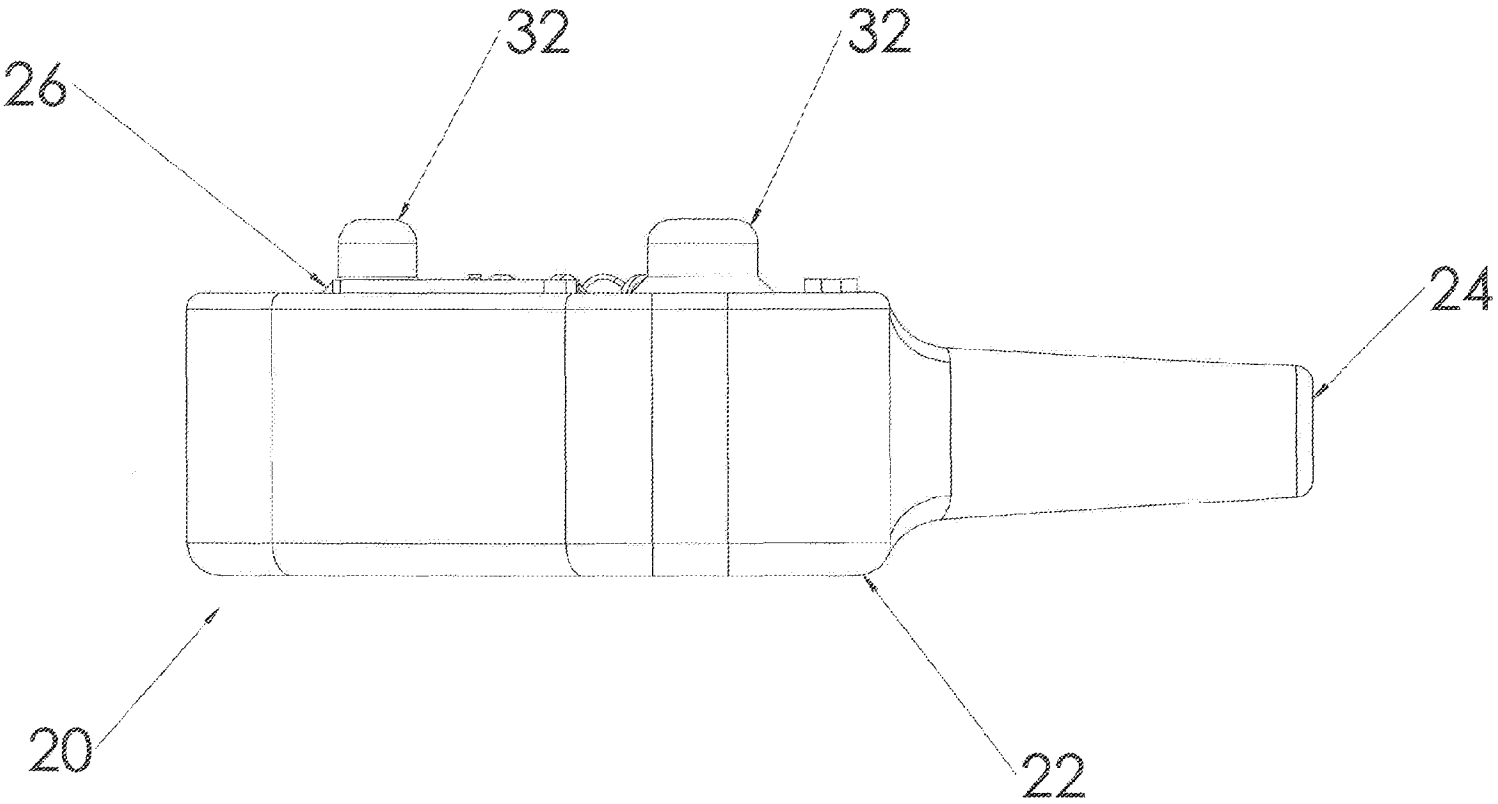
Figure 5:
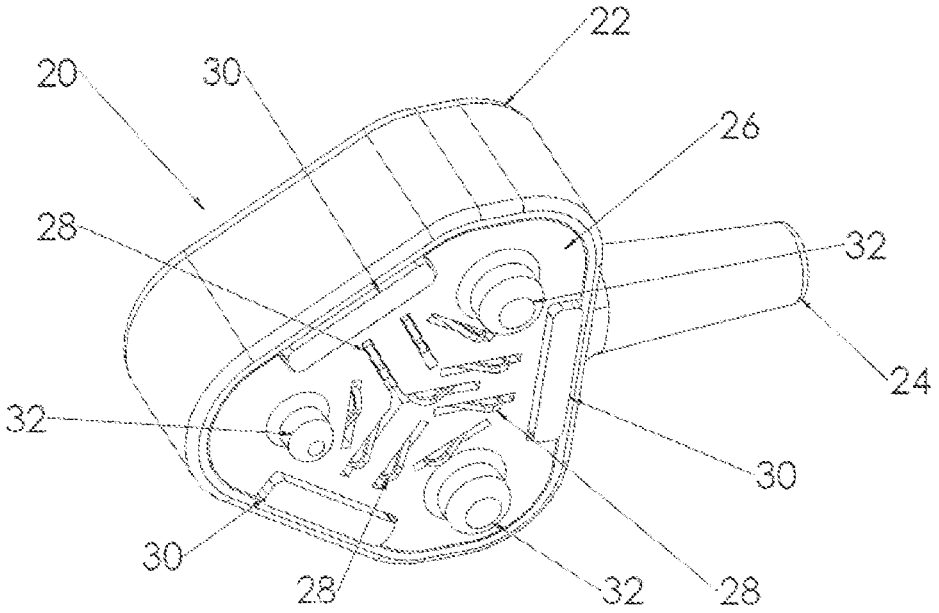
Figure 6:
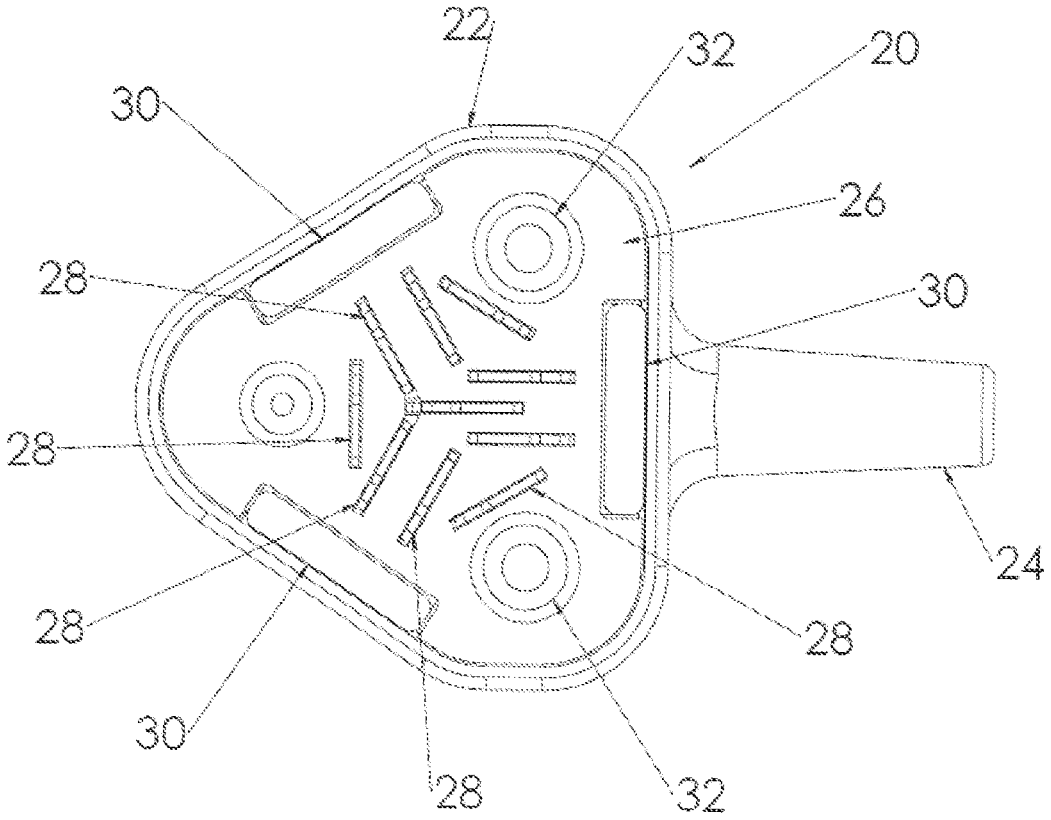
Figure 7:
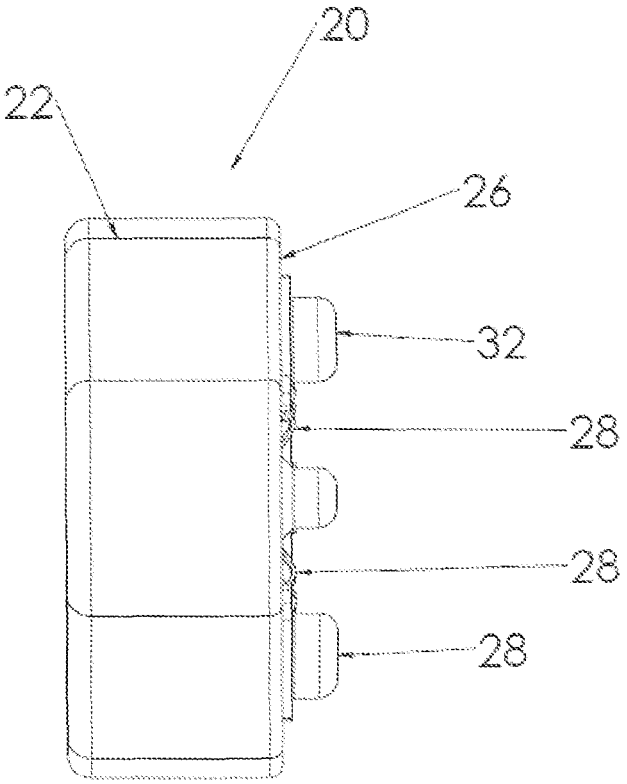

FIG. 3: is a diagrammatic side elevation in cross section of the front face of the jack of FIGS. 1 and 2.

FIGS. 4-7: are a side elevation, perspective view, front elevation and end elevation, respectively, of an embodiment of a plug that may be used with a socket such as that shown in the preceding figures.

Figure 9:
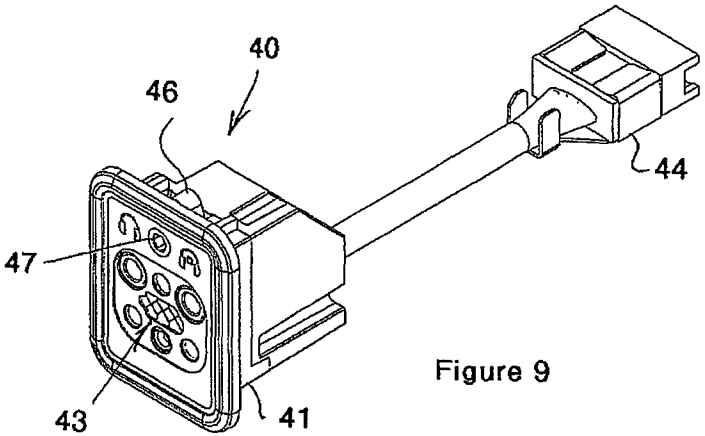
Figure 10:
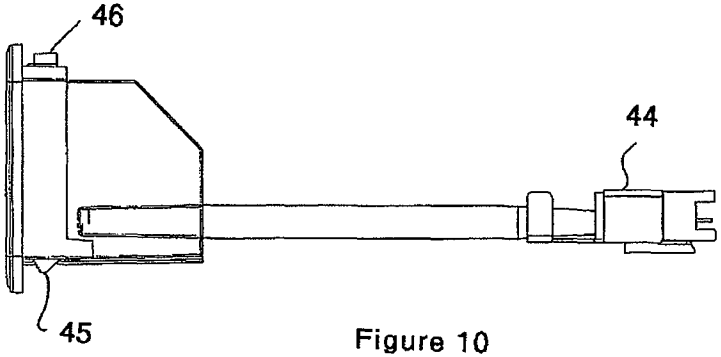
Figure 8:
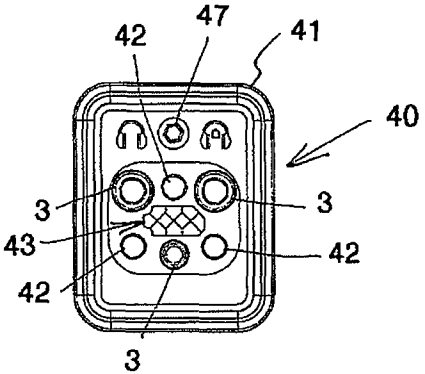

FIGS. 8, 9, 10: illustrate a second embodiment of a receiver or a socket according to the invention.

Figure 8A:
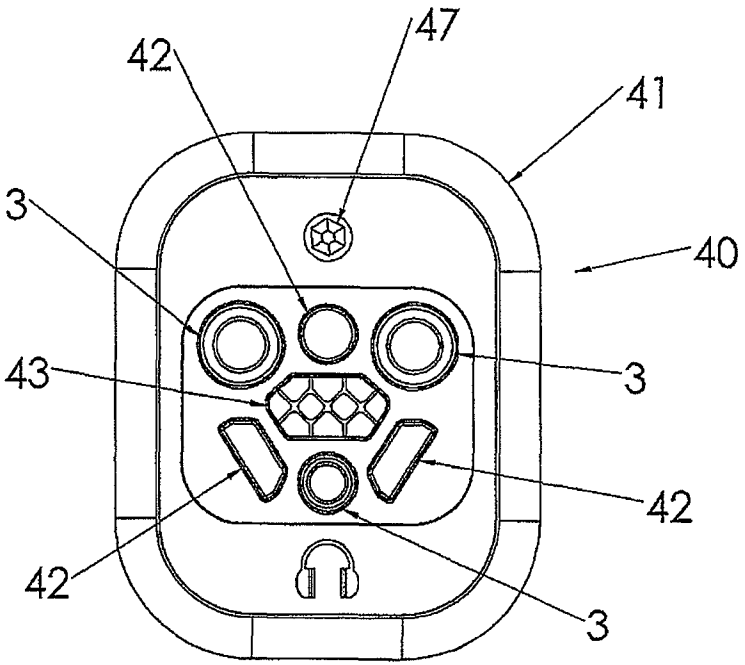
Figure 9A:
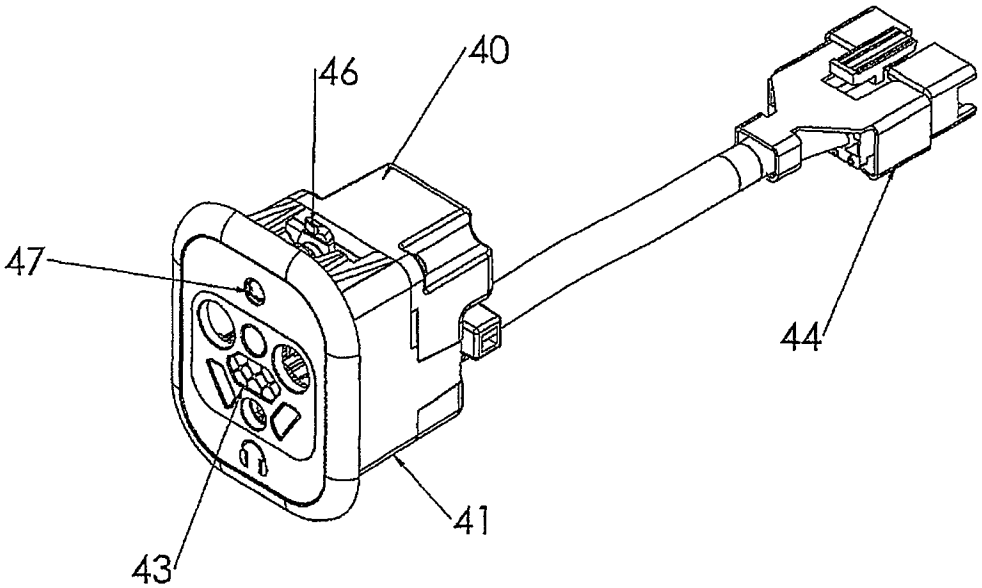
Figure 10A:
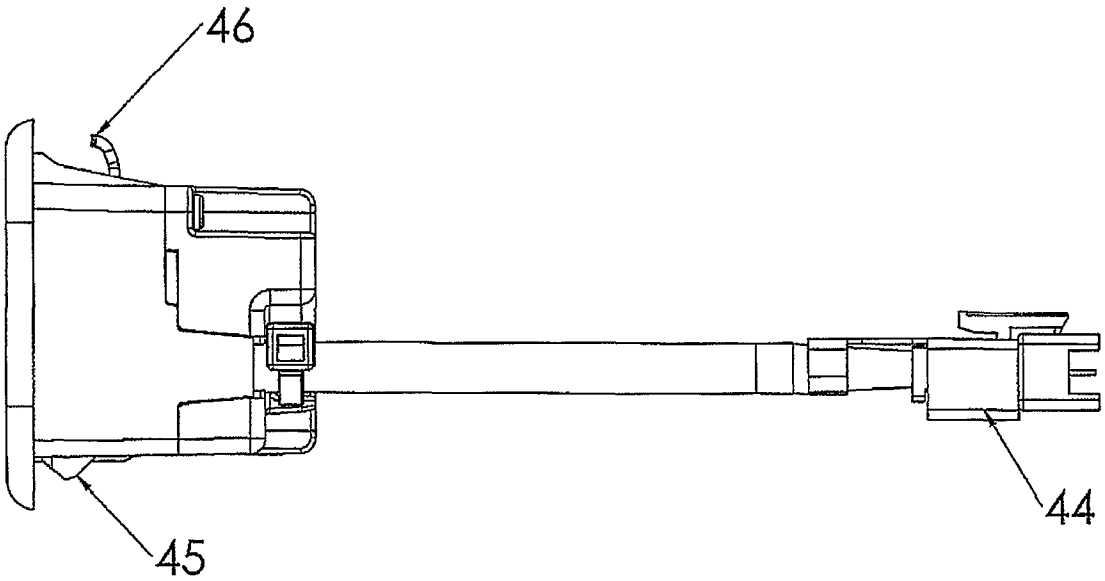

FIGS. 8*a*, 9*a*, 10*a*: show an alternative embodiment to that of FIGS. 8, 9, 10

FIG. 11 part 1 and FIG. 11 part 2: show a diagrammatic enlarged view of a plurality of contact regions and the associated electrical function for each region for the socket of FIGS. 8-10.

FIG. 11*a* part 1: shows an alternative diagrammatic enlarged view of a plurality of contact regions.

FIG. 11*a* part 2: shows associated electrical function for each region for the socket of 11*a* part 1.

Figure 11B:
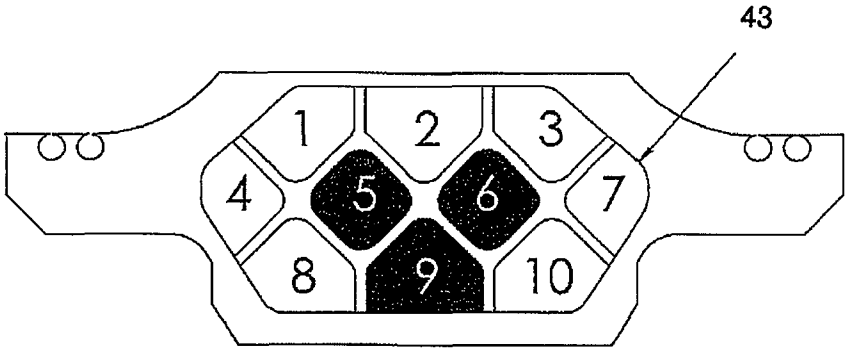
Figure 11C:
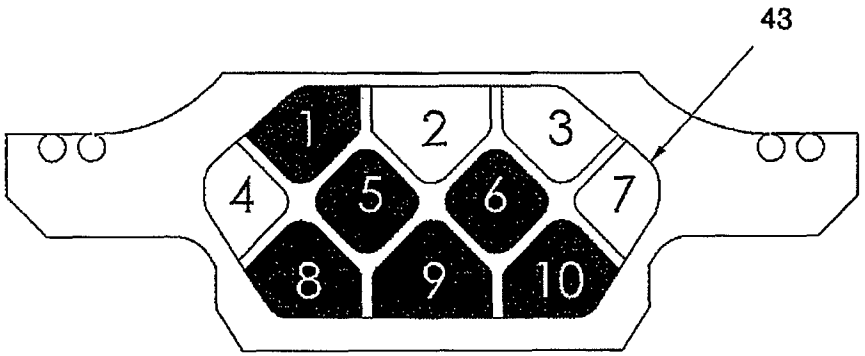
Figure 11D:
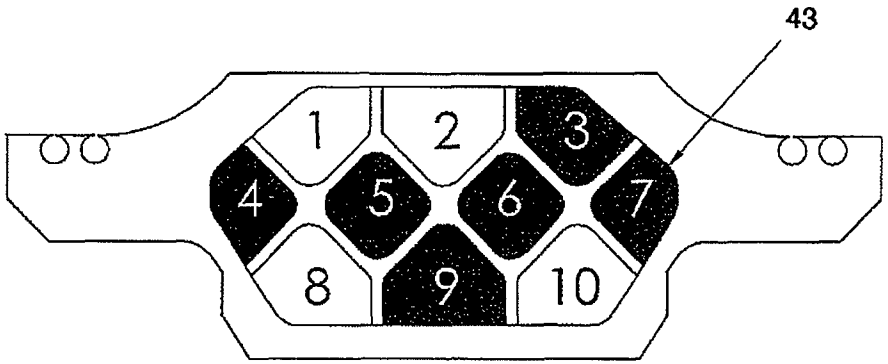

FIGS. 11*b*-11*d*: show alternative arrangements of connections to the conductor regions.

Figure 11G:
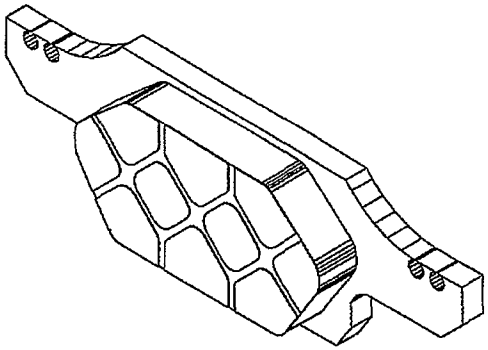
Figure 11F:
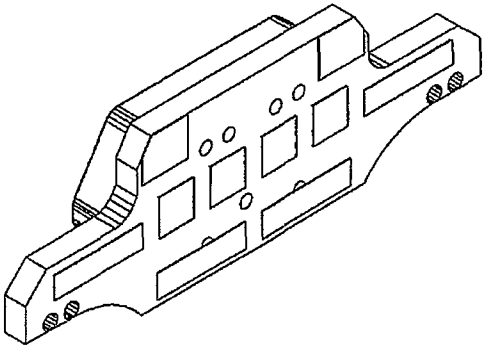
Figure 11E:
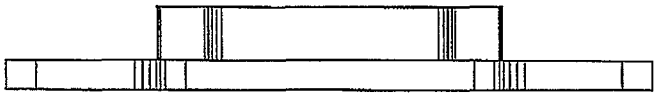

FIG. 11*e-g*: show embodiments of the connections between the plurality of conductor regions and electrical contacts on the reverse of the socket.

Figure 13:
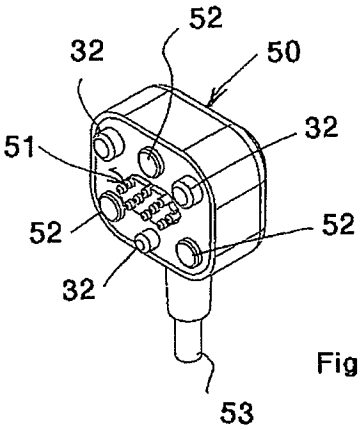
Figure 14:
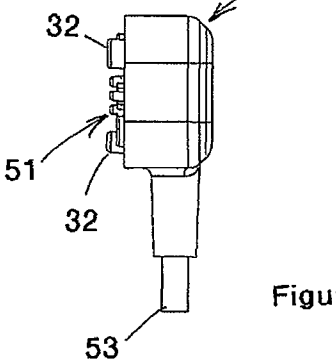
Figure 12:
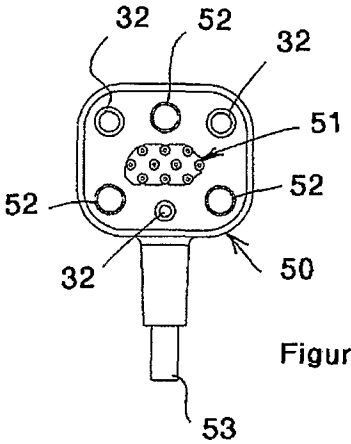

FIGS. 12, 13, 14: show a plug for use with the jack of FIGS. 8-10. with an alternative arrangement provided in.

Figure 12A:
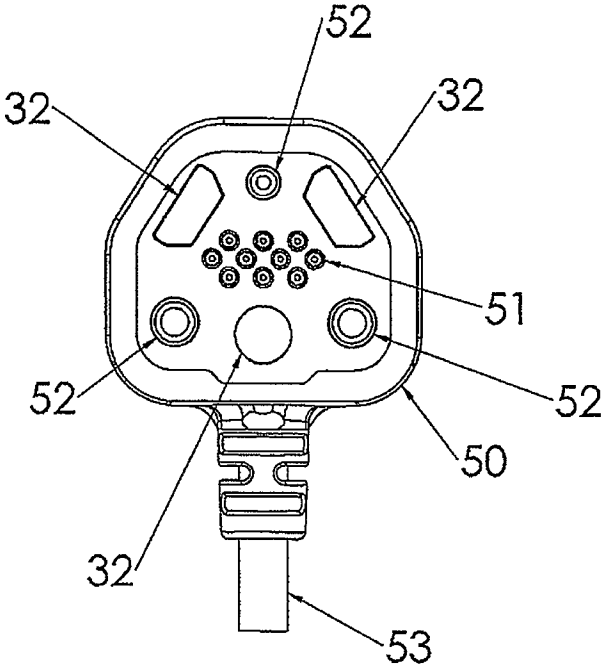
Figure 13A:
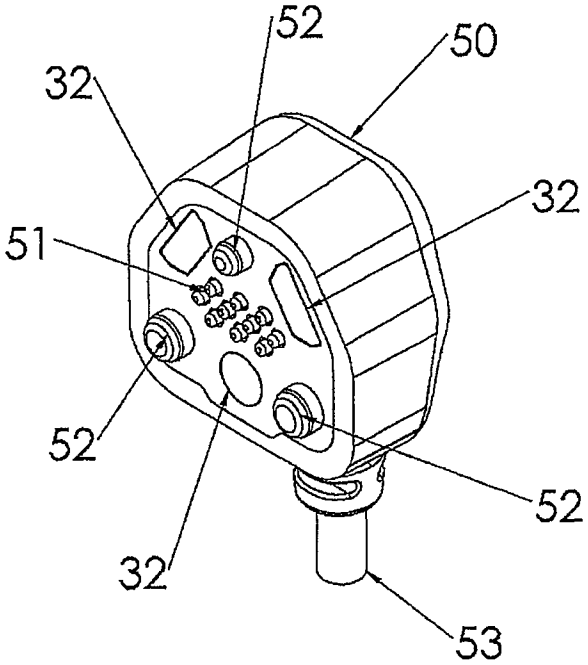
Figure 14A:
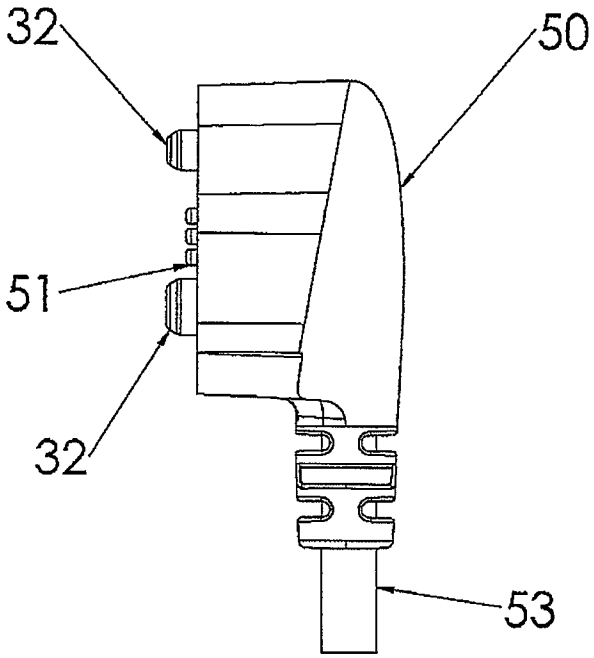

FIGS. 12*a*, 13*a*, 14*a*: show an alternative arrangement for a plug for use with the jack of FIGS. 8-10.

Figure 14B:
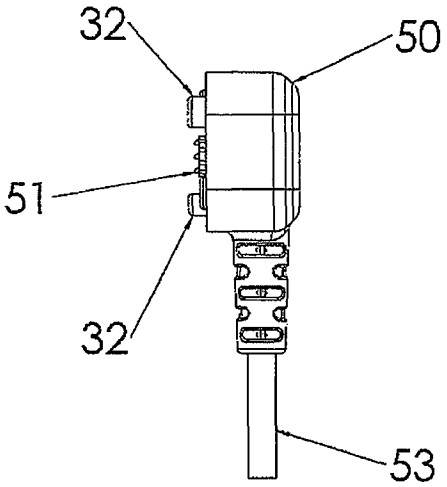
Figure 14C:
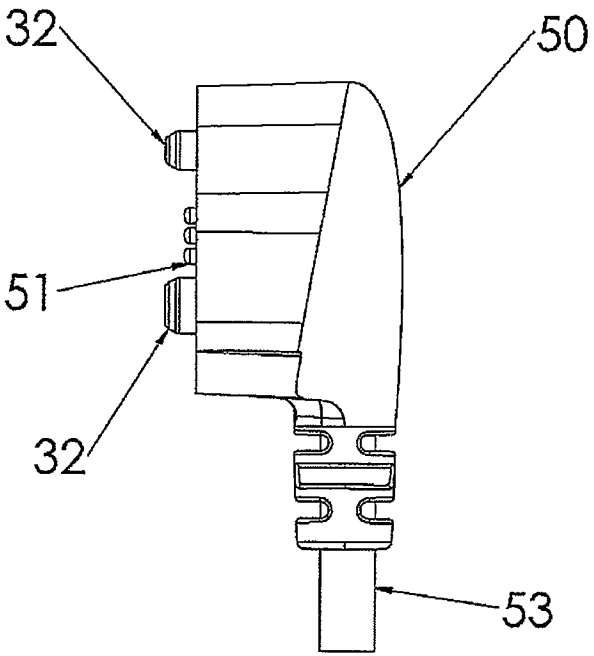

FIGS. 14*b* 14*c*: show further alternative arrangements for a plug for use with the jack of FIGS. 8-10.

Figure 15:
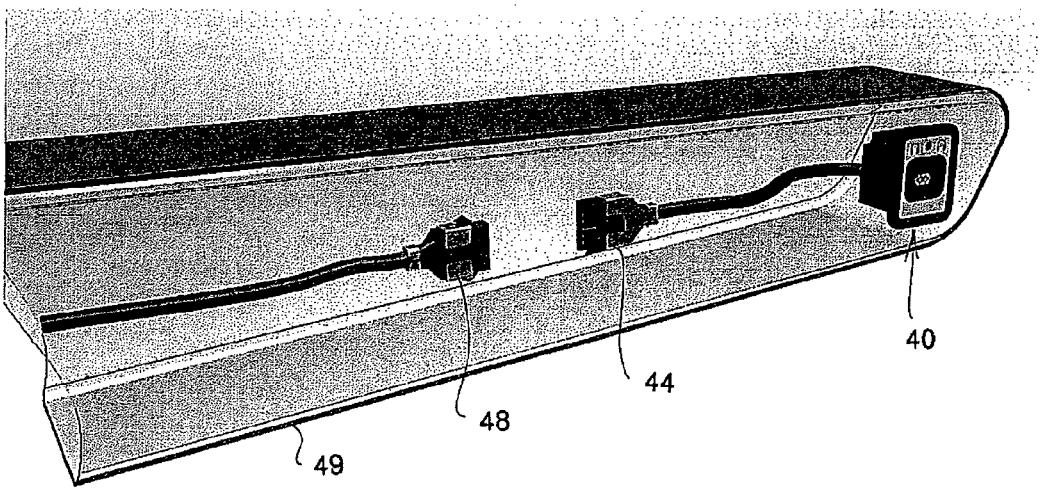
Figure 17:
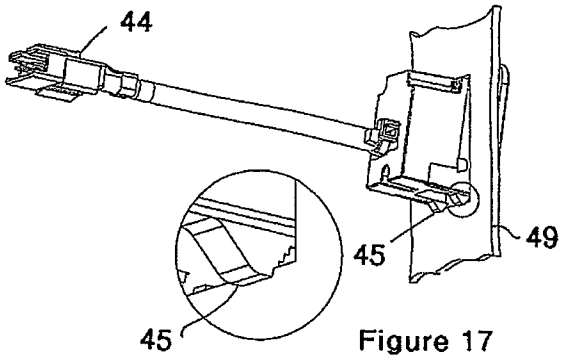
Figure 16:
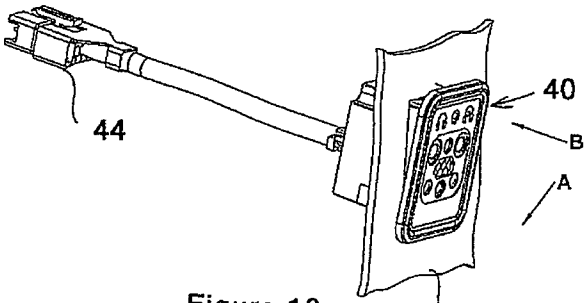

FIG. 15: shows a diagrammatic illustration of the apparatus of the preceding Figures in use in a vehicle arm rest.

FIGS. 16-19: illustrate an installation process for the socket of FIGS. 8-10.

FIGS. 16*a*, 17*a*, 18*a*, 18*b*, 19*a* and 19*b*: show alternative embodiments of the installation process for the socket of FIGS. 8-10.

Figure 20:
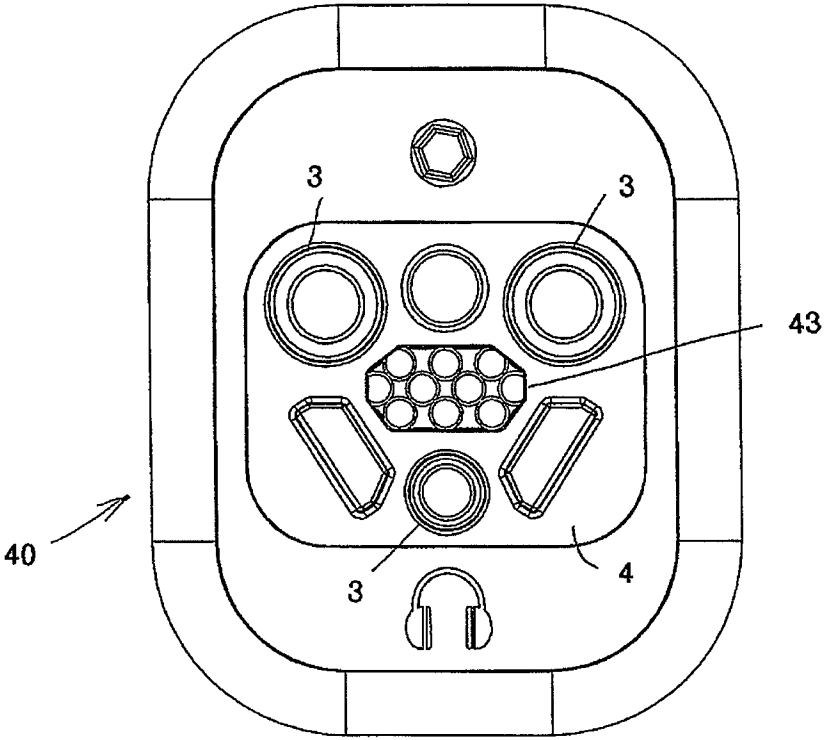

FIG. 20: shows a front elevation of a further embodiment of the invention.

Figure 20A:
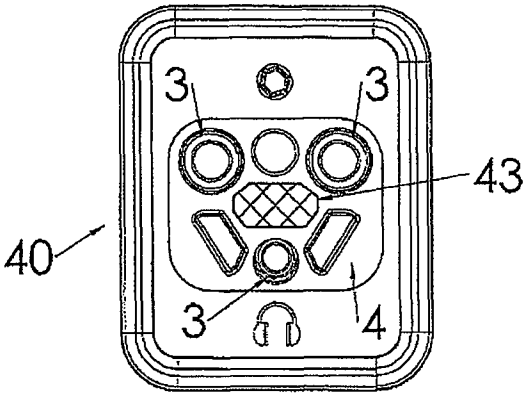

FIG. 20*a*: shows an alternative front elevation of alternative embodiments of the invention.

Figure 20C:
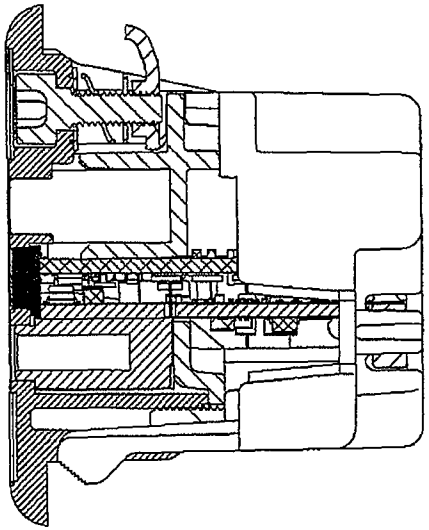
Figure 20B:
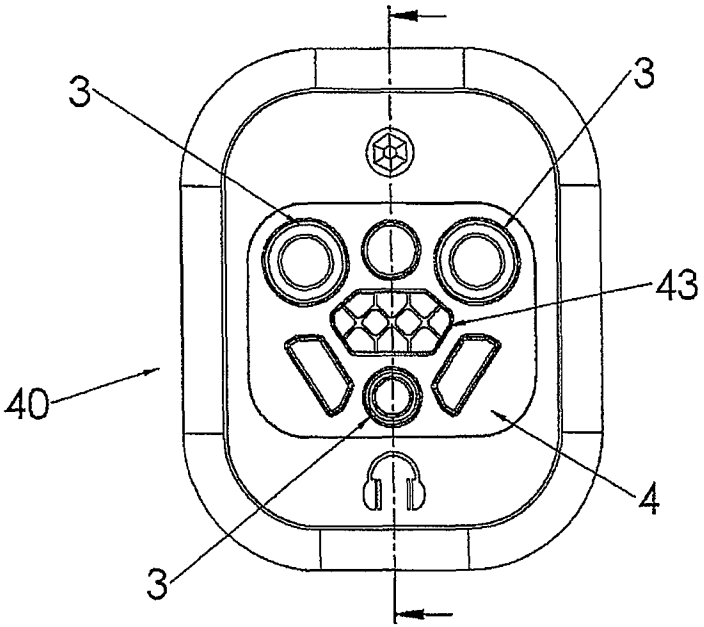

FIGS. 20*b* and 20*c*: Show front and side elevations of a further embodiment of the invention.

Figure 21:
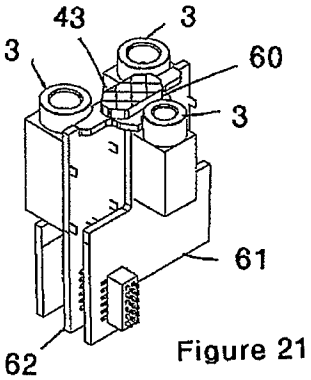
Figure 22:
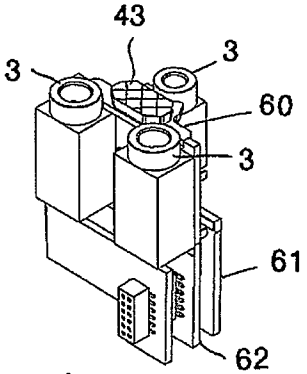

FIGS. 21-22: are isometric views of a printed circuit board arrangement on which plug pin receivers and conductor contacts are provided for the embodiment of FIG. 20.

FIGS. 21 a and 22*a*: show arrangements for the receivers and conductor contacts for an embodiment of FIG. 20 where the contact pads are not shown.

Figure 23:
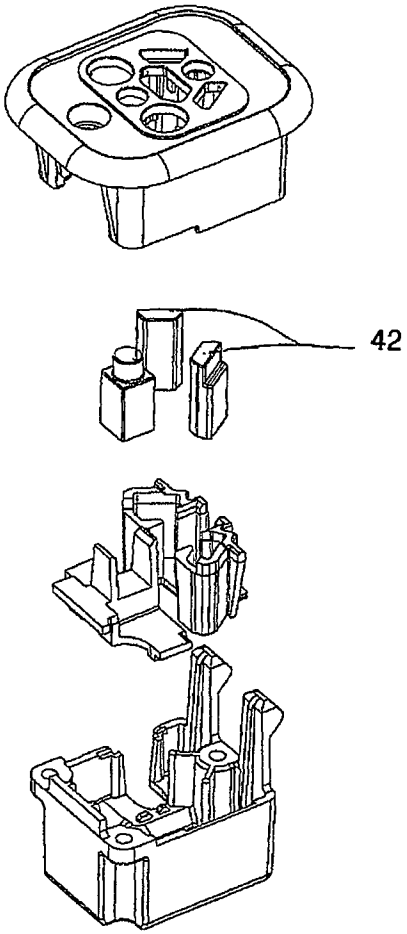
Figure 24C:
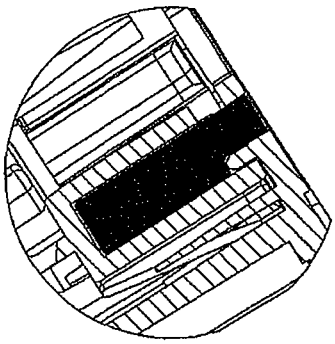
Figure 24F:
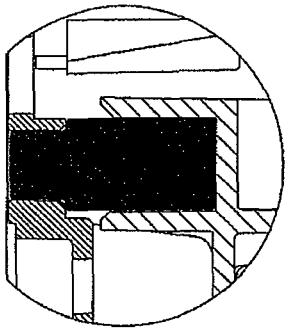
Figure 24B:
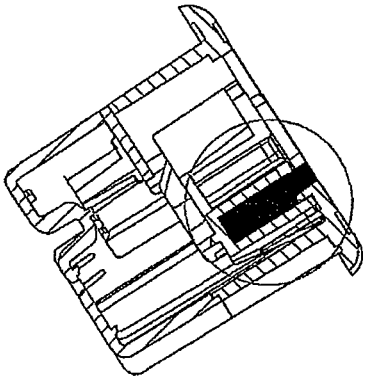
Figure 24E:
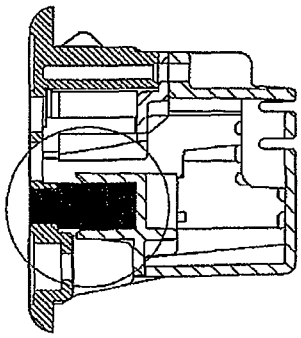
Figure 24A:
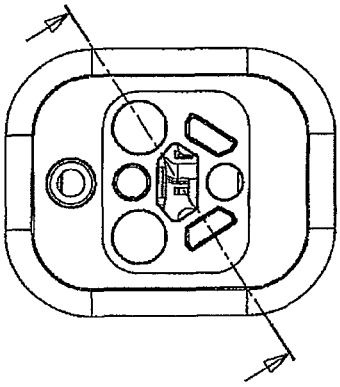
Figure 24D:
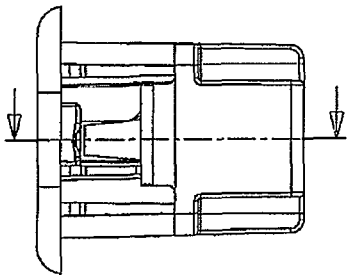

FIG. 23: shows a diagrammatic illustration of how the magnets may be inserted into the socket.

FIG. 24*a-f*: show a bisection of the socket demonstrating an embodiment of the invention.

Figure 25A:
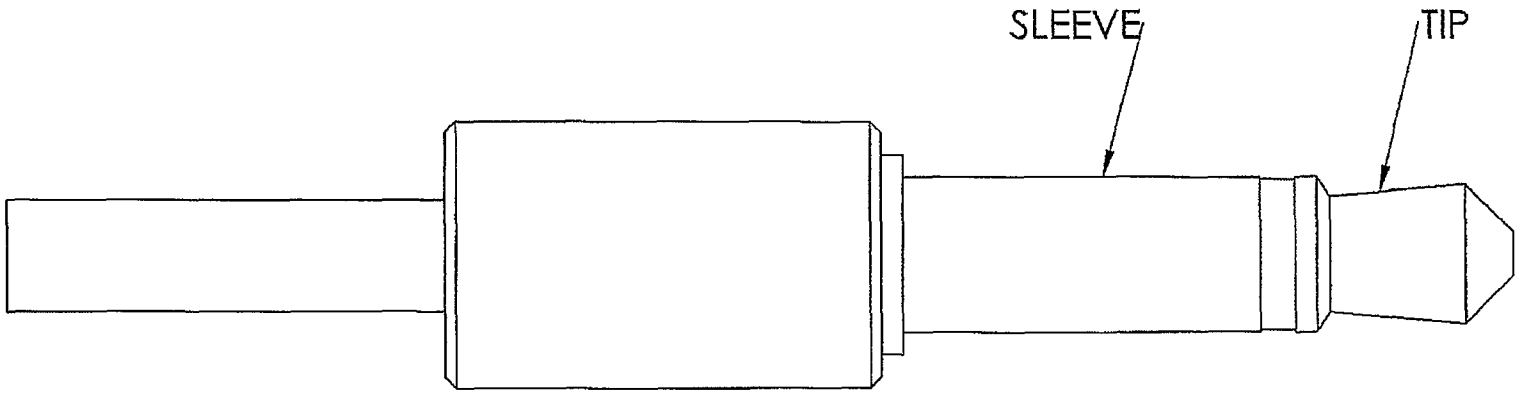
Figure 25B:
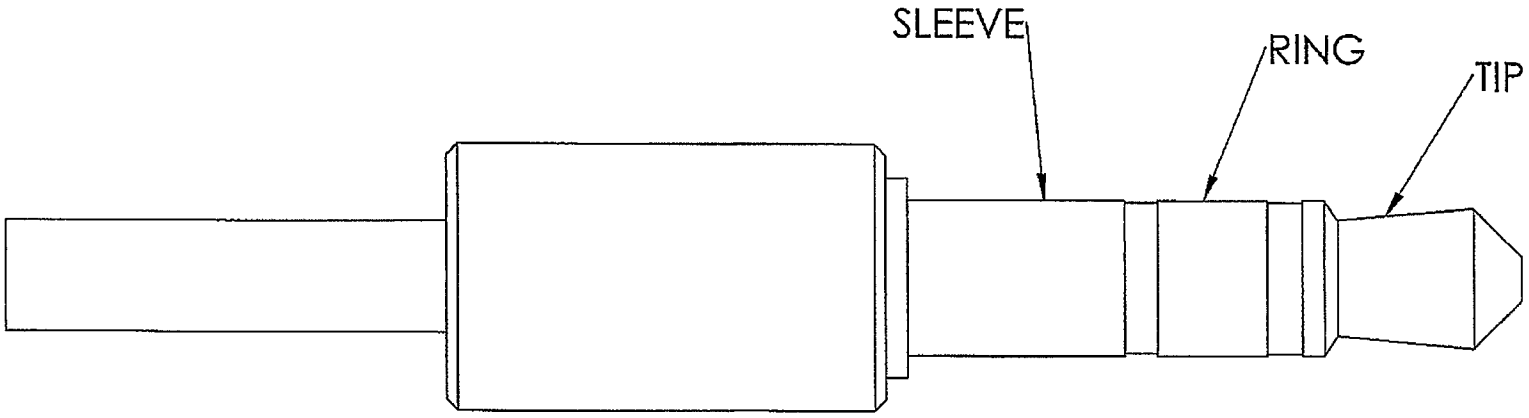

FIG. 25*a-b*: show two plugs that may be inserted into some embodiments of the socket.

Figure 26:
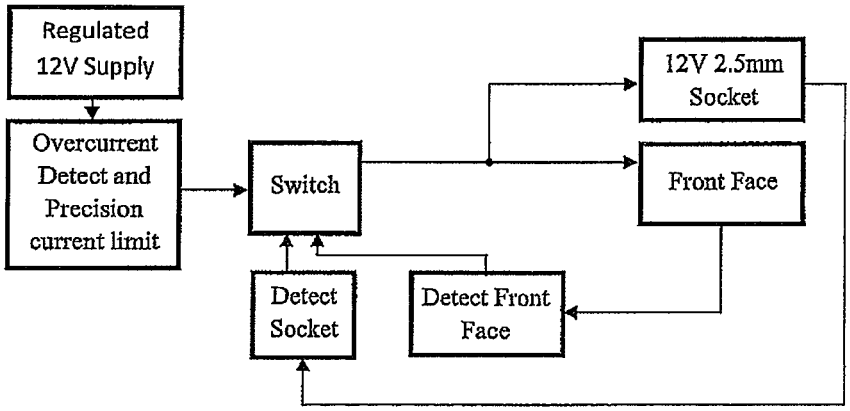

FIG. 26: shows a flow chart of an embodiment of a protection means for the socket.

Figure 27:
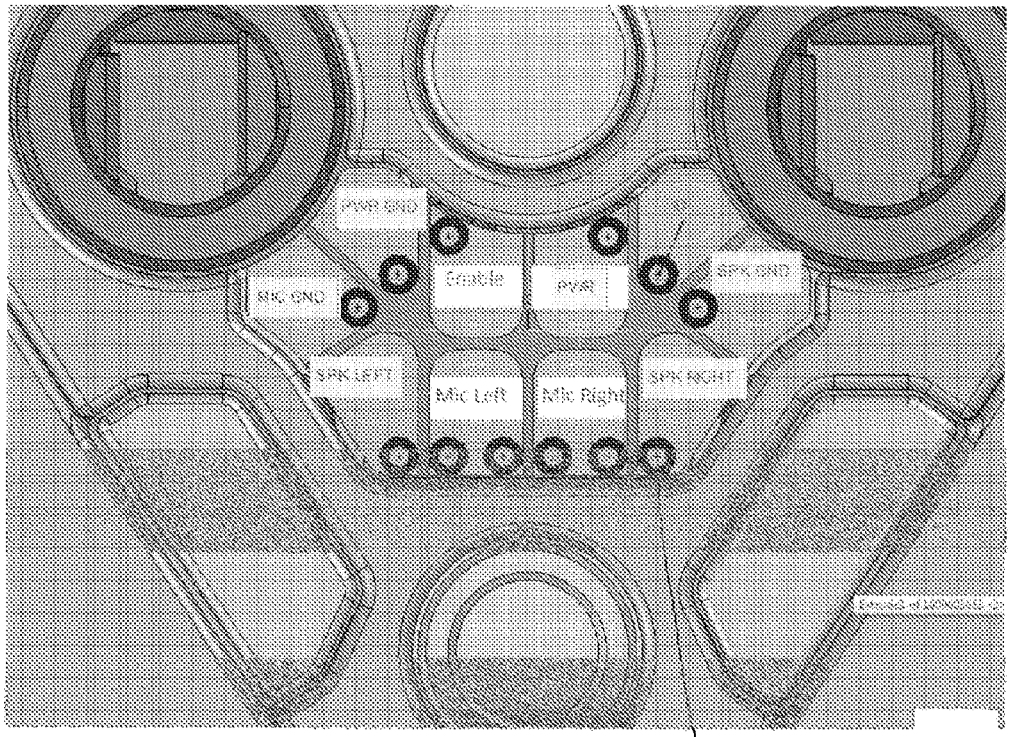

FIG. 27: shows an embodiment of the front face of the socket.

Figure 28:
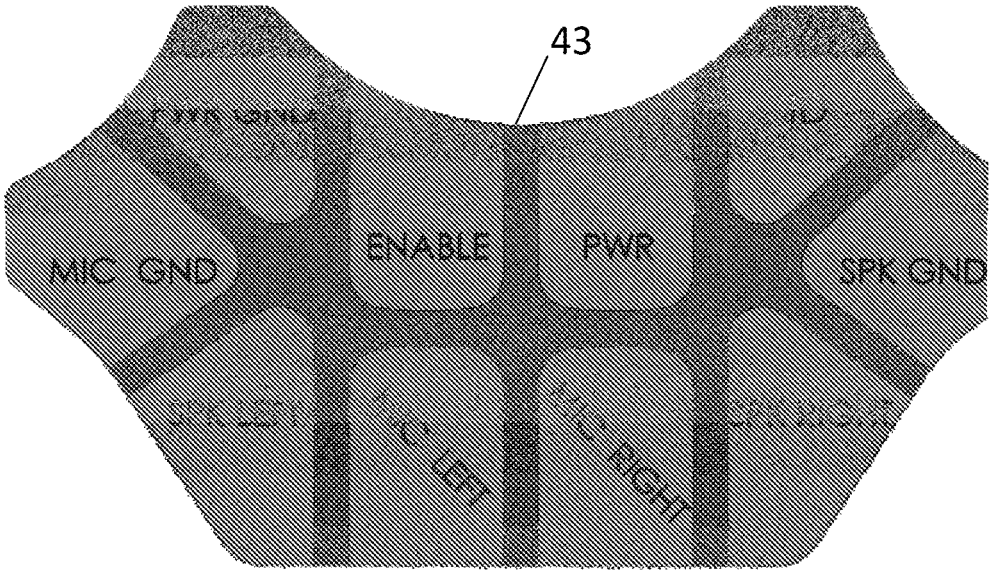

FIG. 28: shows a diagrammatic enlarged view of an embodiment of the plurality of contact regions and an embodiment the associated electrical function for each region for the socket.

Figure 29A:
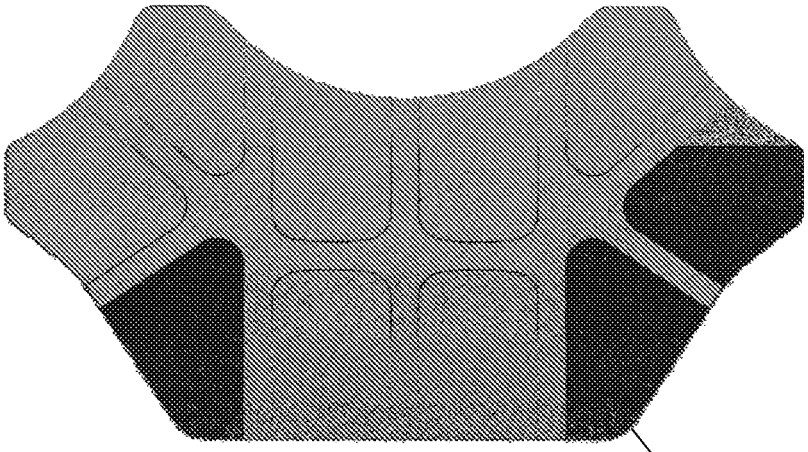
Figure 29B:
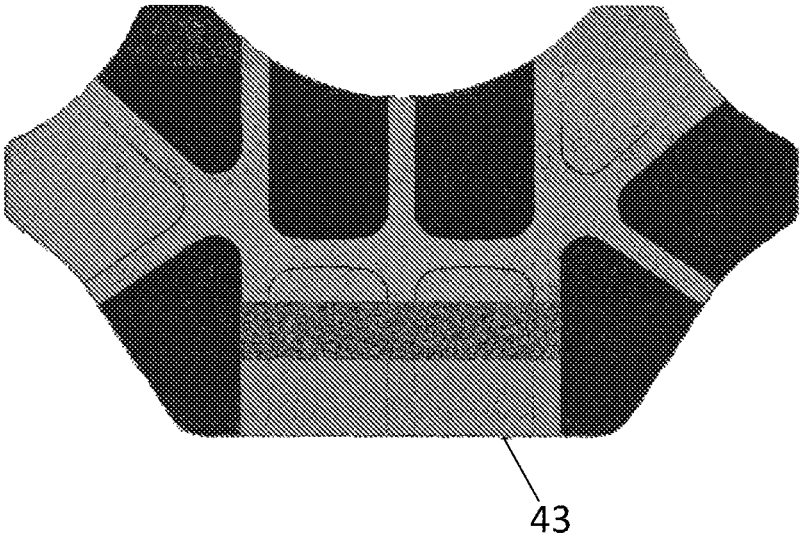
Figure 29C:
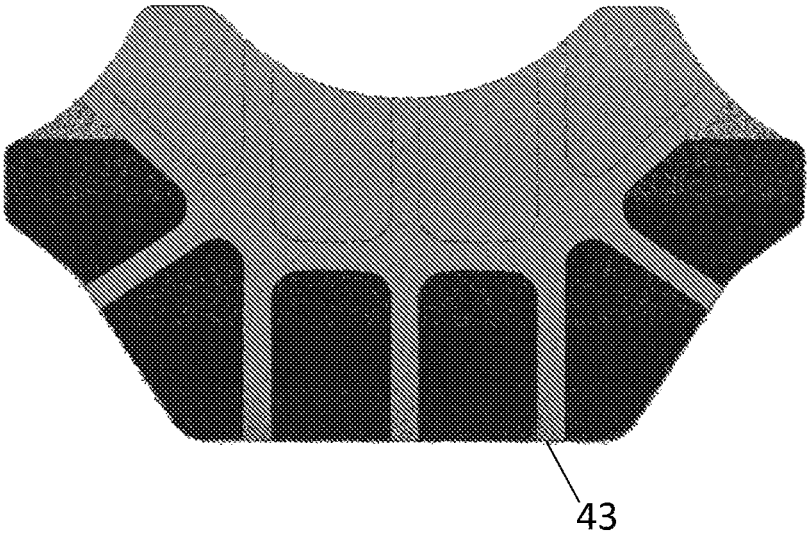

FIGS. 29*a-c*: show embodiments of possible conductor region connections for plug layouts.

DETAILED DESCRIPTION OF THE DRAWINGS

Those skilled in the art will appreciate that the words "socket" or "jack", and "plug" are used for the purposes of convenience, since the connection apparatus and system described in this document comprises components which may not conform to the traditional definition of a socket, jack or plug. Instead, the terms "socket" and "jack" are used to refer generally to a connector component which is connected to a communication system or a media delivery device or system for example, and the term "plug" is used to refer to a connector component which is typically attached to a device used by a user, such as a headset for example.

Although the embodiments discussed below are referred in the context of audio delivery apparatus such as headsets and noise cancelling headphones, the invention is not intended to be limited to that application. Therefore, it should be appreciated that the invention is applicable to connector apparatus in general, and includes within its scope connector apparatus for use in communication systems such as "SKYPE" headsets and/or mobile telephone connection devices and/or MP3 media delivery device charging interfaces or connectors amongst other various applications.

Referring to FIG. 1, a socket is shown generally referenced 1. The front elevation shown in the drawing reveals the front face of the socket as it would appear ready to receive a "plug" of a connector. Those skilled in the art will appreciate that the socket construction as shown in FIG. 1 is an example of an existing socket which may be used in conjunction with a noise cancelling headset. Therefore, the socket as shown in FIG. 1 is one which can be used with an existing form of plug, i.e. being capable of receiving one, two, or up to three pins of an existing plug construction, but which is also adapted to receive an alternative form of plug which is held in place by virtue of magnetic means which act between the socket and the plug, as will be described further below. Those skilled in the art will appreciate that the invention as described below may also be implemented in a socket and/or plug construction which does not provide the existing conventional plug pin and plug pin receiver construction.

Therefore, referring still to FIG. 1, the socket 1 includes a housing 2 which supports three pin receiving sockets 3. The housing has a face 4. In the embodiment shown, face 4 comprises part of a contour in the housing defined by raised edge 5 which may be used to facilitate correct interconnection between the socket and the plug, as will be described further below.

Located behind face 4 of the plug (i.e. within the housing) is a magnetic means comprising one or more magnets 6 which are diagrammatically represented in FIG. 1 for purposes of explanation despite not normally being visible. Those skilled in the art will appreciate that only a single magnet need be provided in some embodiments, and that more than two magnets can be provided in other embodiments. It will also be appreciated that magnets can be provided in different positions, other than those shown. Magnetism may be conducted through metal contacts to facilitate magnetic fields suiting connection to the plug whilst minimising the volume of socket. Furthermore, those skilled in the art will appreciate that, rather than being magnetised, the material which is used may simply be a magnetically permeable material i.e. a material which facilitates a magnetic attraction with a magnet or magnetised material provided in a plug, for example. Alternatively, magnetic means 6 may comprise magnets which act on magnetically permeable material (rather than a magnet per se) which is provided in or on a plug adapted for connection with the socket 1.

Referring now to FIG. 2, the socket of FIG. 1 is again illustrated, but this time showing contact (i.e. electrical conductor or terminal) regions on face 4. Conductor contact regions 7 are in this embodiment provided to allow the required number of contacts to adequately support a noise cancelling headset. Conductor contact regions 8 may provide a power supply for operation of a device such as a noise cancelling headset. The contacts 7 and 8 are provided such that they are exposed conductors adapted to make electrical connection with appropriate conductor contacts disposed in similar locations on the plug which is adapted for connection to the socket 1. Therefore the contacts 7 and 8 are provided in front of the magnetic means 6. This is shown more clearly in FIG. 3. Further the contact regions 7 and/or 8 may provide dedicated contacts for connection to telephony (Voice over IP) headsets and other communication equipment.

Turning now to FIG. 3, the housing face 4 is shown, and it can be seen that above the housing face 4 a conductive layer 10 is provided. Layer 10 is configured to be connected at its periphery (not shown) or at another convenient location, with the appropriate conductors within the housing 2 for the electrical connections required to enable operation of the socket. This conductive layer 10 is shaped, or has an appropriate insulating region to enable the plurality of contact regions to be provided. The physical dimensions or extent of contact areas 7 and 8 can be defined by applying a non-conductive (and preferably appropriately cosmetic) layer 11 which therefore defines the required shape of each of the contact regions 7 and 8.

Alternatively, rather than the construction shown in FIGS. 2 and 3 , those skilled in the art will appreciate that the face 4 may be constructed such that the connector regions project above a surrounding insulated region. For example, the connector regions may comprise spring contacts, as will be described further below with reference to FIGS. 4 to 7. Regarding the power supply contacts 8, in one embodiment, a detector is included in the socket, so that when a plug is correctly connected to the socket, then the power supply is made available to contact regions 8 so that the supply can be used by the plug. Otherwise, the power supply is not available at contact regions 8 for safety purposes. This can be achieved by a mechanical switch for example, or alternatively, by electrically detecting connection of the plug with the socket or by using impedance detection circuitry to detect the nature of the connection made. Thus in one embodiment the contacts 7 may be used to electrically detect the presence of the plug, and in another embodiment the presence of a plug pin within a pin receiver of the socket may be used to perform the detection step. Alternatively, the contact regions 8 may be recessed sufficiently so as to make inadvertent shorting or other electrical contact unlikely.

In one embodiment, the conductive layer 10 and the non-conductive layer 11 may be constructed as "decals" which are easily manufactured and attached to body 2 of a socket 1 during a manufacturing process.

Furthermore, the outer contour of the face 4, as defined by edge 5 may be used to ensure that a correct alignment is achieved between the socket 1 and an appropriate plug. Therefore, the plug (not shown) may include a recess which corresponds with edge 5 to ensure a correct alignment is achieved in use between the socket and the plug. Alternatively or additionally, other alignment contours may be used to ensure that not only is alignment between the socket and plug correct, but also that the orientation of the plug is correct relative to its socket.

Referring now to FIGS. 4 to 7, one embodiment of a plug which may be used with the socket of the preceding figures is illustrated. Referring to those figures, the plug is shown generally referenced 20, having housing 22. The housing includes an opening 24 to allow a lead or cable to be connected to the housing. Although not shown in FIGS. 4 to 7, the housing contains one or more magnetic means such as magnets or magnetically permeable material, as discussed above in relation to the socket 1. In one embodiment, the magnet means is provided rearwardly of contacts 28. The upper surface 26 of the plug 20 includes a number of contacts 28. In this example, the contacts 28 comprise spring contacts i.e. the contacts project beyond surface 26 and are biased outwardly, but capable of being pressed back toward surface 26 on contact with the connector regions of the socket. Those skilled in the art will appreciate that other forms of contact 28 may be provided. the upper surface 26 also includes one or more alignment means which include contours and such as projecting portions and/or stubs 32. In use, the contours 28 can locate about outer surfaces of the peripheral edge 5 of the connector, and the stubs 32 may be provided within the pin receivers 3. Those skilled in the art will appreciate that other arrangements are possible, and that the stubs 32 could also include some form of communication connection (i.e. include one or more conductors) and/or may also include one or more magnetic means.

Turning to FIGS. 8 to 10, a second embodiment of a socket is illustrated. Again, the socket may include conventional functionality including pin receivers 3 for receiving pins of one or more known headset plugs. The socket has magnetic areas 42. In a preferred embodiment these comprise permanent magnets (for example rare earth magnets), but in other embodiments may simply be ferromagnetic material for co-acting with a magnet or magnets in similar areas on a plug. The apparatus is generally referenced 40 and has a housing 41. Associated with the housing 41 are locating projections 45 and a controllable location projection 46. The function of these features will be described further below.

As can be seen, a plurality of conductor contact regions arranged in a group 43 in which the contact regions are substantially co-planar is provided. These are shown in more detail in FIG. 11 part 1 and part 2. The individual regions are labelled 1 to 10 in that figure and an example of an appropriate function for each electrical contact region in the context of an audio headset is also illustrated in FIG. 11. It can be seen that the individual regions are arranged in three rows, the regions in the first and third rows being substantially aligned with each other, (i.e. regions 1, 2, 3 and 8, 9, 10) and the second or middle row (i.e. regions 4, 5, 6 and 7) has contact regions that are offset from the first and third rows. Furthermore, it can be seen that the region bounded by the contact regions 43 has a distinctive shape which may be adapted for receiving a part of the plug, as described further below. The shape thus helps to ensure that the plug and the socket can be aligned in only one way and therefore the correct contacts are made between the plug and the socket. The shape of the socket places design limitations on the conductor contact regions. In particular the space available is limited. It is cost effective to have the individual conductor regions, and any corresponding pins, as far apart as possible. Similarly the core functionality terminals should be placed in closest proximity to the largest magnets. This ensures that a strong connection is made at these points and that the audio communication is as clear as possible. An alternative embodiment of the socket is shown in FIGS. 8*a*, 9*a* and 10*a*.

An alternative group 43 of conductor contact regions is shown in FIG. 11*a* part 1 and FIG. 11*a* part 2, including an indication of preferred connections for each region provided thereunder. For example, regions 5 and 6 are shown providing connection to right and left audio driver signals, respectively.

Passengers in different aircraft cabin classes are often provided with different types of headphones, with differing functionality. The arrangement shown in FIG. 11*a* is configured to provide balanced mechanical forces irrespective of the particular connection required to the socket by ensuring that the contact regions used are substantially symmetrical around the centre of the group 43, to the extent practicable. This is illustrated in FIGS. 11*b*-11*d* which show the contact regions which are used for different types of connection for different types of headsets.

FIG. 11*b* shows the contact regions that may be used for a more conventional stereo headset which may typically be found in economy class areas within an aircraft. FIG. 11*c* shows the contact regions that may be used when Active Noise Reduction (ANR) functionality is enabled via region 1. FIG. 11*d* shows the contact regions that may be used when powered ANR functionality is provided by a headset. ANR functionality is more typically used in premium flight classes.

As can be seen by comparing FIGS. 11*b*-11*d*, the same core functionality is provided via the same core contact regions 5, 6 and 9 positioned substantially centrally within the group 43, with other regions therearound being used as required. Thus the pressure on the face of the group 43 is substantially balanced, preventing concentrated/localised forces at the edges of the group. In an alternative situation, shown in FIGS. 27, 28 and 29*a-c* the core functionality may be provided by a set of core contact regions placed at each end on the group of conductor regions and substantially balance the pressure on the face of the group. For instance, the selected regions in FIGS. 29*a-c* may provide contact regions for a series of different plugs, in one instance these may be a stereo headset, active noise reduction headset and a powered active noise reduction headset. The locations of the core contact regions may also be influenced by the position of the magnets, with important signals being placed at the points with the strongest resultant magnetic pulling force. The core contact regions may be electrically connected to another face of the plug, for instance, as shown in FIGS. 11*e-g*.

Thus the socket is capable of connection with one of a plurality of possible plugs at any one time. The plugs may have different electronic pin-outs i.e. pin arrangements. The position or location of the pin-outs in the plugs is selected so that plug pins contact the conductor regions which provide the required functionality for any given application. The group of conductor regions is arranged so that the pressure on a face of the group of conductor regions is substantially balanced for each of the plurality of pin-outs when the plug and socket are in contact.

Having the connector and plug remain substantially parallel to each other reduces the mechanical wear, improves the contact and signal communication, reduces the pressure on the connection, and improves the safety of the connection. The pins of the plug are preferably spring contacts, biased to project; in a situation where the plug and socket were not balanced so as their faces were substantially parallel this would cause stress on the pins projecting further from the face of the plug, whilst others would be compressed. This increased stress on the pins will cause increased mechanical wear, increased failure rate and additional cost. The effect of unbalanced connections on the conductor regions is also undesirable; the pressure difference across the face of the conductor region may also cause unnecessary wear or failure. When there is electrical contact between the pins and the conductor regions it is desirable to have the connections as consistent as possible. If the pins/conductor regions are not connected in a balanced manner, such that they remain substantially parallel to each other, it is likely that at least some of the plurality of pins will not have a strong connection with the appropriate conductor region. This may lead to intermittent transfer through the electrical connection or malfunctioning of the device. Further problems may arise when the unbalanced nature of the connections leads to rocking or shaking of the unit. This may become particularly apparent when small, or minimum magnetic fields are used. When the connection between the pins and conductor region is well balanced there is also improved safety as, because the pins and conductor region are substantially parallel and closely connected, there may be less risk of foreign objects or liquids interrupting the connection.

While particular inputs/outputs have been shown for the contact regions, the invention is not limited thereto. Further, more or less contact regions may be provided, as desired. For example, without limitation, the contact regions may be configured to interface with a Skype or other IP-based telephony handset or headset or with a USB-type device instead of or in addition to providing the connectivity described above. Other data-type connections are also possible.

A plug for use with the socket of FIGS. 8 to 10 is shown in FIGS. 12 to 14. As with the previous embodiment, the plug, which is referenced 50, has a cord 53 and has projections 32 if required to assist with alignment with the socket. Magnets or magnetic regions 52 are provided to co-act with the magnets or regions 42 of the socket. A plurality of pins 51 is arranged in appropriate rows as described with reference to the plurality of contact regions 43 of the socket. The array of pins 51 may project slightly as shown in FIG. 13 for reception in an appropriately contoured recess of the socket. The pins 51 may comprise spring contacts which are biased to project but can move axially back toward the body of the plug upon contact with the socket. Alternative embodiments of the plug are shown in FIGS. 12*a*, 13*a*, 14*a*, 14*b* and 14*c*.

Turning to FIG. 15, an armrest 49 is shown such as an aircraft seat armrest, which may include a connector 48 that forms a part of the aircraft or vehicle IFE system. The socket 40 is engaged in the armrest and the plug 44 may be engaged with the connector 48.

Figure 19:
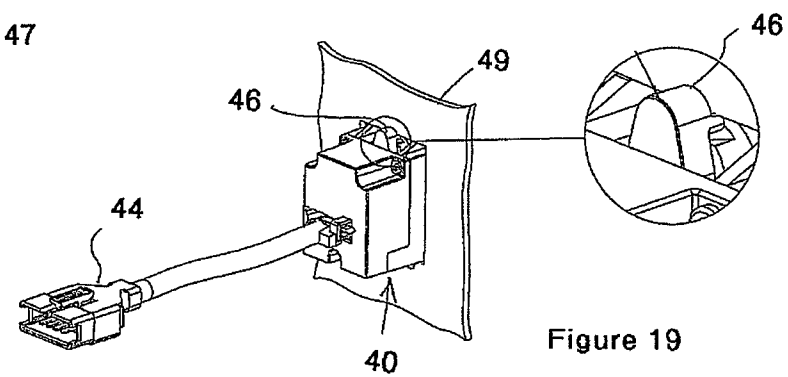
Figure 18:
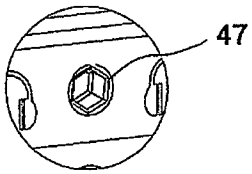
Figure 18:
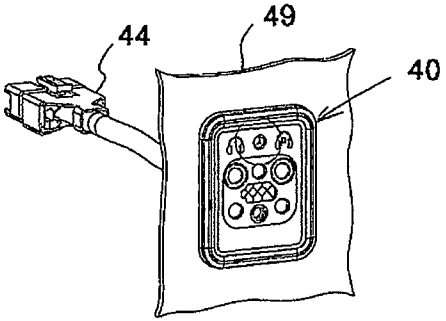
Figure 16A:
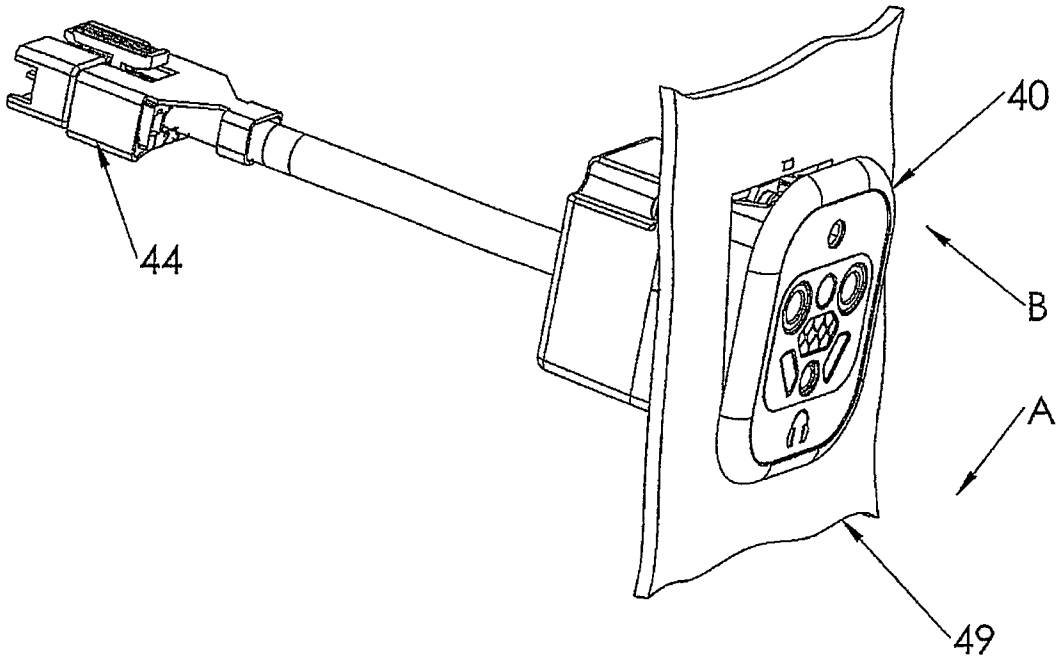
Figure 17A:
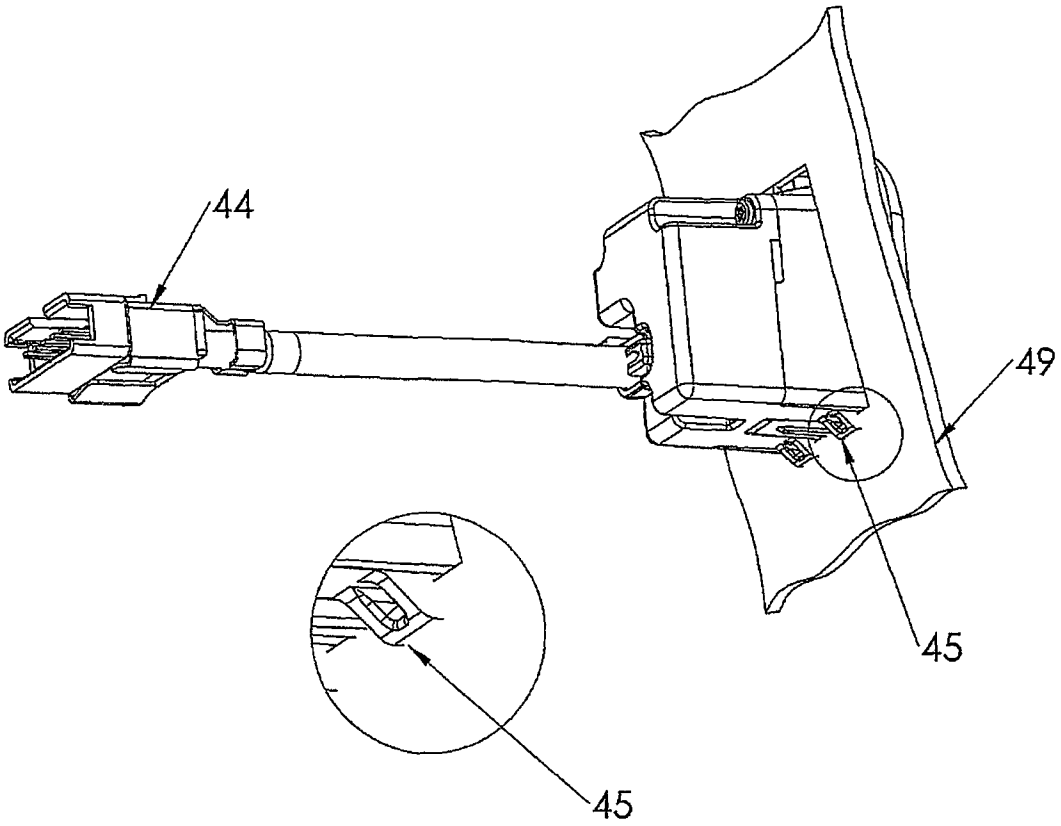
Figures 18A, 18B:
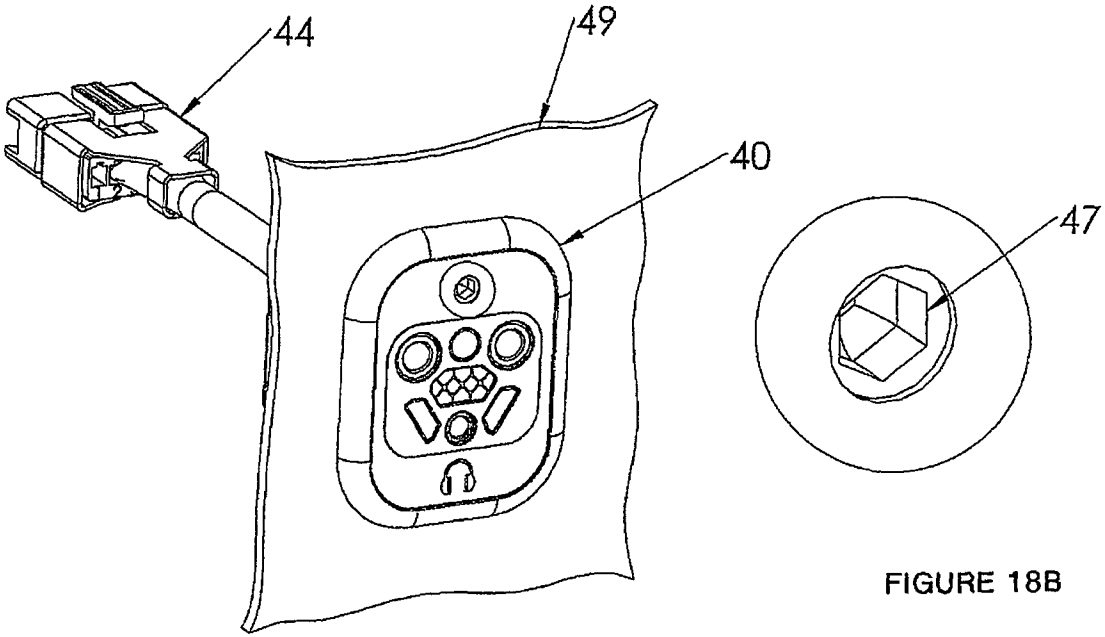
Figure 19B:
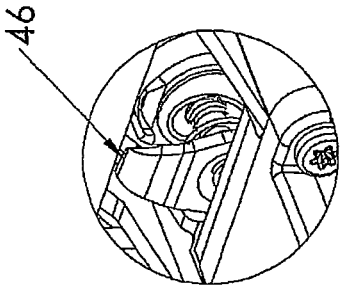
Figure 19A:
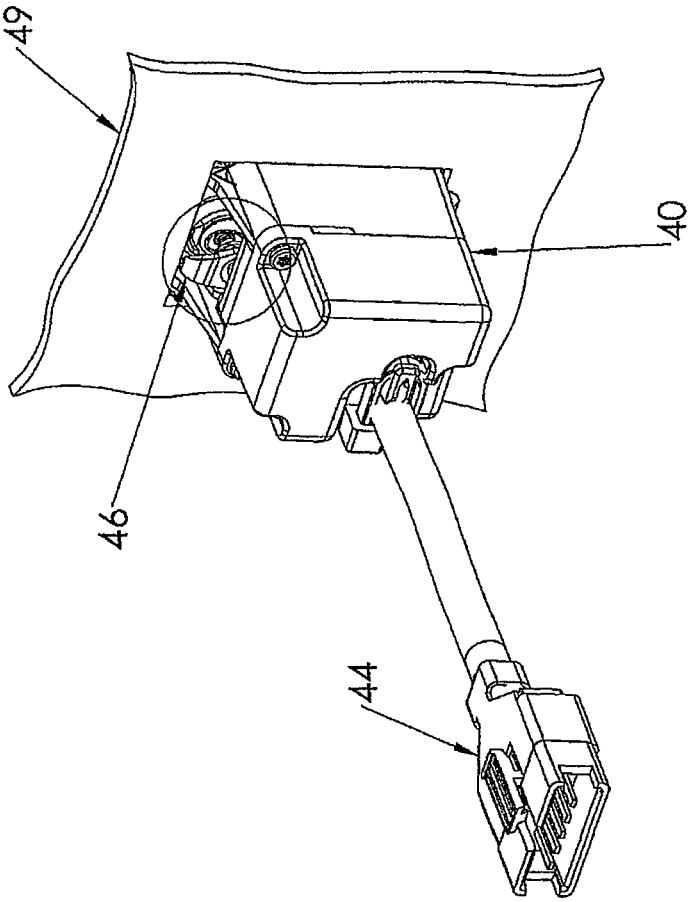

In FIGS. 16 to 19, an installation process for the socket 40 into armrest 49 is illustrated. As can be seen, the location projections 45 engage with the lower part of a cutout in the armrest 49. The projection 46 is lowered by using an Allen Key or other appropriate tool to rotate projection 46 through use of the tool receiving socket 47. Once the socket 40 is in place, the projection 46 is moved so that it projects from the housing and prevents the socket 40 from being removed from the armrest 49, as shown in FIG. 19. FIGS. 16*a*, 17*a*, 18*a*, 18*b*, 19*a* and 19*b* demonstrate an alternative installation process.

A further embodiment of socket is shown in FIG. 20 in which the group 43 of conductor contact regions is has a different physical form, but comprises three rows of conductor contact regions which are provided adjacent to each other in the same plane. In this embodiment the group 43 is substantially flush with the surrounding portion of face 4 so that there is no lip or ridge about which dirt or grime can accumulate and thus cause a malfunction. A further embodiment of the socket is shown in FIG. 20*a*. FIGS. 20*b* and 20*c* show a socket front face and the side elevation along a cut-through line respectively.

Figure 21A:
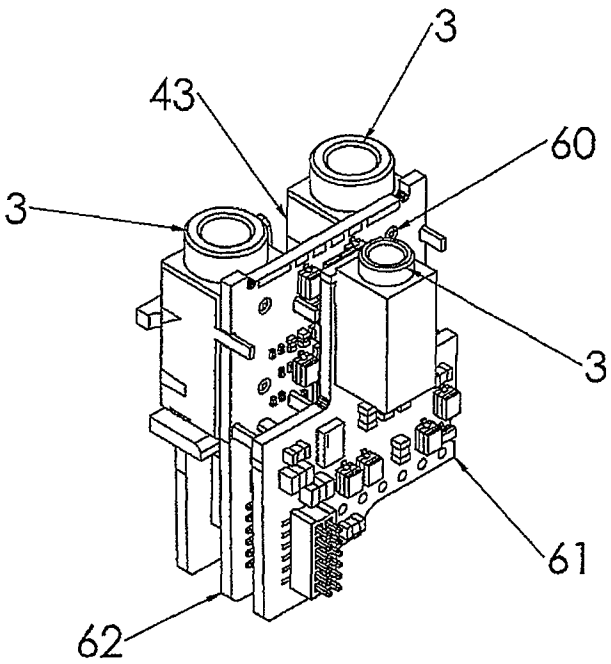
Figure 22A:
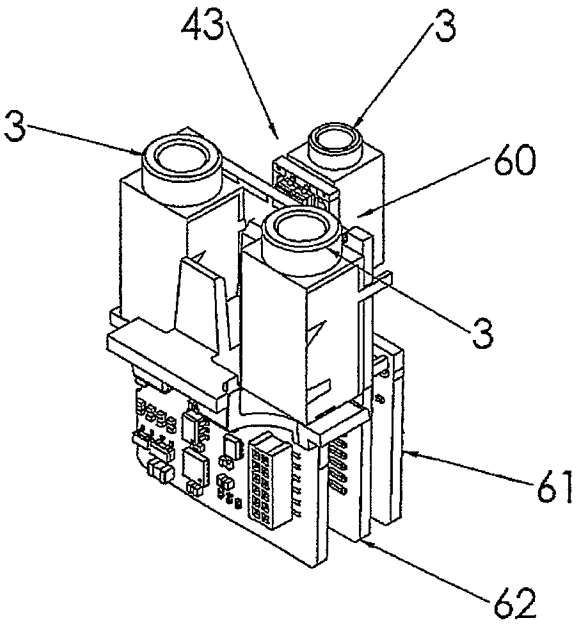

FIGS. 21 and 22 show an arrangement of printed circuit boards 60, 61 and 62 which may be used with an embodiment such as that of FIG. 20. Circuit board 60 has a conductor layer that provides the group 43 of conductor contacts and is machined so that the group 43 protrudes from the remainder of the board. In this way, the housing can be located about the board 60 so that the group 43 is substantially flush with face 4 upon assembly. Board 60 also facilitates location of boards 61 and 62 which carry plug pin receivers 3. FIGS. 21*a* and 22*a* show alternative embodiments of the invention, the plurality of conductor regions has been removed for ease of view.

One problem with the group 43 layout is that short circuiting may occur between the contact regions. For example, a passenger may insert an electrical conductor into the socket. According to one embodiment, this may be overcome by providing a 12v enabling circuit that is not enabled unless a two pole connector is inserted and detected. Such an arrangement is shown in FIG. 26 and provides short circuit detection and power enablement.

A typical 2.5 mm audio connector as used on a mobile telephone has a plug with 3 conductors as shown in FIG. 25*b*, namely at the tip, a ring and a sleeve. Between the tip and the sleeve is a driver output and between the ring and the sleeve is a microphone input.

The circuit of FIG. 26 features a front face detection circuit that only enables 12V power output if a power plug (as shown in FIG. 25*a*) is inserted. In this case the ring connection is connected to ground by insertion of the plug and external power is enabled. Power will not be enabled if a 3 or 4 pin 2.5 mm plug is detected.

Another source of short circuiting is where an electrical conductor or a conductive liquid is spilt across the contact pads. This is overcome by a 12V enabling circuit that will not activate unless an enable pin is set to ground. The circuit of FIG. 26 provides this functionality whereby the Enable pin must be driven hard to ground to enable voltage output on the front face.

A liquid spill will not provide a low ohmic connection to ground to enable the switch. The conductivity of a liquid (for example sugar syrup) is significantly less than that of the dedicated copper short created by connecting the correct magnetic plug. The invention provides a front face detection circuit to measure conductivity and enable output voltage appropriately.

It is common for passengers to plug a 2.5 mm headphone plug into the 12 v power socket. It is also conceivable that a similar type connection could be made to the front face such that the 12 v enabling circuit is overcome. This issue may be resolved by a current limiting circuit that restricts current flow from the 12 v power supply such that no low impedance or short circuit can heat up electronics in the jack or a headphone plug or connected device.

Again, with reference to FIG. 26, if for some reason the passenger manages to overcome the front face enable detection or the socket detection then embodiments of the invention provide an over current detection and precision current limit circuit. The current limit circuit restricts current flow from the 12 V power supply such that no low impedance or short circuit can heat up electronics in the jack or a headphone plug or connected device. Embodiments of the invention feature an 'auto recover' current limit that will periodically monitor the current drawn and limit it to a pre-defined level. When the fault condition or short circuit is removed the apparatus will recover and continue normal operation.

To further protect the jack from initiated passenger short circuits all pins whether they are signals or power have independent short circuit protection i.e. all conductive pads and socket terminals are protected in the event of independently being shorted to ground.

Pin 1—ENABLE—High Impedance pin. Protected by in line resistance.

Pin 2—ID—High Impedance pin. Protected by in line resistance.

Pin 3—MIC GND—Already at GND potential.

Pin 4—MIC RIGHT—High Impedance pin. Protected by in line resistance.

Pin 5—DRIVER RIGHT—Protected by in line resistance.

Pin 6—DRIVER LEFT—Protected by in line resistance.

Pin 7—MIC LEFT—High Impedance pin. Protected by in line resistance

Pin 8—V+—Protected by Enable Pin and precision current limit circuit.

Pin 9—DRIVER GND—Already at GND potential.

Pin 10—POWER GND—Already at GND potential.

In some cases passengers may attempt to use A0 style headphone connections which have a conductive shield or outer, this connection type is particularly common in high quality stereo headphones. The conductive shield or outer of these headphones should be shorted to a ground potential for safe operation of the connector. This can be accomplished by placing the ground conductor regions of the contact regions near or next to the 3.5 mm sockets of the connector.

Passenger liquid spill particular of sugary liquids across the front face could be a source of isolation of the front face pads from plug pins. To resolve this issue the front face of the jack has been made as flush as possible to enable easy cleaning with a damp cloth or the sleeve of a passengers or flight attendants clothes. The flush front face can be enabled many ways. A) One way is to use a step control depth routed circuit board located to the rear of the front face. B) Another way is to use plated plastics (likely to be a lower cost method in high volumes).

According to one embodiment, the faceplate of the group 43 is elevated to a desired height by mounting thereof on a predetermined number of thicknesses of PCB base material. According to another embodiment, a single PCB board may be partly routed away to provide multiple depths. This is not a frequently used construction technique but can provide the required connectivity between the main circuit boards and the front face which requires a greater area than that of the front face. This is used to protect the main electronics from the customer and only expose the front face.

FIG. 11*e* shows small exposed contacts on the front and significantly larger contacts on the underside.

To eliminate seams or unevenness on the front face the front face locking has no dedicated key holes or slots. Instead using key holes the holes of the existing ARINC C2 socket for preventing lateral movement, locating and positioning the plug on the front surface. Further the combination of the magnet locations on the front face are such that combined with the existing ARINC connector holes they prevent miss-alignment of the Magnetic plug contacts on the front face conductive pads.

According to preferred embodiments, the magnetic jack is designed using magnets that provide a strong magnetic force (e.g. neodymium or an electromagnet). This enables the magnetic material in the plug to be manufactured from low cost non-permanent magnetic elements, reducing the costs of manufacture. Further, preferably the 3 magnets are all positioned with the same polarity at the face of the socket to ensure the field strength and shape maximise the pull strength with the magnet. Thus, the contact portions of the plug may simply be formed from a ferrous material rather than both the plug and socket requiring permanent magnets in order to provide the required magnetic strength to effect the coupling such that nuisance disconnects are avoided but disconnects are possible such as when discussed above (eg a user stands or knocks the lead with a tray).

The magnetic jack can be manufactured to several shapes to fit in existing aircraft seat audio socket cut-outs as it is expensive for airlines to change cut-outs in seats. There are four main seat cut-outs and the jack may be specifically adapted to fit into any of them, including the following: 1401 cut-out, 1406 cut-out. To facilitate fitting the sockets, magnets and conductive pads within such a small space the shape of the magnets is trapezoid to maximise the magnet size whilst ensuring the magnet is mass manufacturable.

According to preferred embodiments, the magnetic jack is manufactured with a separate magnetic holder such that the magnets are separate and electrically as well as magnetically isolated from the seat, magnets and electronics. This also helps with assembly as the magnets tend to pull themselves together. FIGS. 23 and 24*a-f* show an example holder for magnets 42. Further, preferably, the magnetic are designed and formed to be reverse entry magnets i.e., they are inserted into the apparatus from behind the faceplate of the socket. This helps with assembly and ensures that the magnets do not pull out of the jack with wear and tear.

To ensure the face of the group 43 has a flat surface and to improve the life of the front face pads, preferably there are no via's under the pads.

PCB plated edges may be used to provide board interconnect. In some cases no pads may be provided on the PCB. This facilitates connection in a small space without the use of the connector.

The examples described above may be used in conjunction with an in-flight entertainment system—the socket being provided in or adjacent to a passenger seat, and the plug being provided on a headset. The socket is intended to have a very long service life. Spring contacts which may be used with magnetic jacks by contrast have a limited lifetime. The plugs are part of headphones which are viewed by airline operators as a consumable device. Therefore where spring contacts are used they can be located on the plug to maximise the lifetime of the conductive surface of the socket.

Those skilled in the art will appreciate that the construction shown has the advantage that multiple contact areas are provided using the layer structure disclosed, so that maximum use is made of the available space and therefore the overall size of the connector and plug arrangement can be kept to a minimum. The magnetic connection is advantageously achieved using a magnetic means provided rearwardly of the connector regions i.e. the connector regions in use become between the magnetic means provided in the socket and the plug. Furthermore, those skilled in the art will appreciate that the socket is provided which may still be used with "legacy" plug arrangements. Therefore, the socket supports a new magnetic plug, but also has the advantage it is functional with existing pin type plug constructions.

The invention claimed is:

1. An electrical connector socket for selective electrical connection with a first plug and a second plug, the first and second plugs having different configurations, the electrical connector socket comprising:

a housing having a first face;

a plug pin receiver comprising an aperture extending rearwardly of the first face, the receiver being adapted to axially receive, and electrically connect to, a plug pin of the first plug and second plug;

a plurality of conductor contact regions provided on the housing to physically and electrically contact conductors of the second plug; and a control circuit adapted to activate, or deactivate, at least one of the plurality of conductor contact regions based on an input.

2. An electrical connector socket as claimed in claim 1 wherein the control circuit is an enabling circuit which activates, or deactivates, an output of the conductor contact regions.

3. An electrical connector socket as claimed in claim 1 wherein the input is any one or more of:

a plug pin being received in the plug pin receiver;

physical or electrical contact in the plug pin receiver;

an enable pin set to ground; or a measurement of conductivity of any one or more of the plurality of conductor contact regions.

4. An electrical connector socket as claimed in claim 1 comprising a current limiting circuit configured to restrict current to at least one of the conductor contact regions when a low impedance, or short circuit, is detected.

5. An electrical connector socket as claimed in claim 4 wherein the current limiting circuit periodically monitors the current in at least one of the conductor contact regions.

6. An electrical connector socket as claimed in claim 1 comprising a substantially independent control circuit for at least two of the conductor contact regions.

7. An electrical connector socket as claimed in claim 1 comprising a ground connected conductor contact region substantially adjacent the plug pin receiver.

8. An electrical connector socket as claimed in claim 1 wherein at least one of the conductor contact regions is substantially flush with the first face of the housing.

9. An electrical connector socket as claimed in claim 1 wherein the plug pin receiver substantially prevents lateral movement of at least one of the first and second plugs.

10. An electrical connector socket as claimed in claim 1 comprising at least one magnet provided in the housing to physically retain the first and/or second plug in connection with the socket, in use.

11. An electrical connector socket as claimed in claim 10 wherein a plurality of magnets are provided in the housing and are positioned with the same polarity towards the first face.

12. An electrical connector socket as claimed in claim 10 wherein the housing is configured so that the magnet is inserted or removed from the electrical connector socket from behind the first face.

13. An electrical connector socket as claimed in claim 1 adapted to fit into an existing aircraft seat audio socket cut-out.

14. An electrical connector socket as claimed in claim 1 wherein the first plug does not electrically contact the plurality of conductor contact regions.

15. An electrical connector socket as claimed in claim 1 wherein a power supplying conductor contact region is activated, or deactivated, by the input.

16. An electrical connector socket as claimed in claim 1 wherein the socket has a shape adapted to align the first and/or second plug in use.

17. An electrical connector socket as claimed in claim 1 wherein the plug pin receiver is configured to electrically connect to stub pins of the second plug.

18. An electrical connector socket for selective electrical connection with a first plug and a second plug, the first and second plugs having different configurations, the electrical connector socket comprising:

a housing having a first face;

a plug pin receiver comprising an aperture extending rearwardly of the first face, the receiver being adapted to axially receive, and electrically connect to, a plug pin of the first plug and second plug;

a plurality of conductor contact regions provided on the housing to physically and electrically contact conductors of the second plug; and wherein at least one of the plurality of conductor contact regions is electrically activated when an input is received.

19. An electrical connector socket as claimed in claim 18 wherein the input is any one or more of:

a plug pin being received in a plug pin receiver;

physical or electrical contact in a plug pin receiver;

an enable pin set to ground; or a measurement of conductivity of any one or more of the plurality of conductor contact regions.

* * * * *